US009617051B2

(12) United States Patent
Lee et al.

(10) Patent No.: US 9,617,051 B2
(45) Date of Patent: Apr. 11, 2017

(54) BOTTLE CAP

(71) Applicants: Jeong-Min Lee, Seoul (KR); Seong-Jae Lee, Seoul (KR)

(72) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 161 days.

(21) Appl. No.: 14/322,316

(22) Filed: Jul. 2, 2014

(65) Prior Publication Data

US 2015/0001108 A1 Jan. 1, 2015

Related U.S. Application Data

(62) Division of application No. 13/517,401, filed as application No. PCT/KR2009/000072 on Jan. 7, 2009, now Pat. No. 8,807,362.

(30) Foreign Application Priority Data

Oct. 17, 2008 (KR) ..... 10-2008-0102820
Oct. 17, 2008 (KR) ..... 10-2008-0102821
Oct. 17, 2008 (KR) ..... 10-2008-0102822

(51) Int. Cl.
*B65D 51/28* (2006.01)
*B65D 47/08* (2006.01)
(Continued)

(52) U.S. Cl.
CPC ..... *B65D 51/2857* (2013.01); *B05B 11/3047* (2013.01); *B65D 41/505* (2013.01);
(Continued)

(58) Field of Classification Search
USPC ..... 206/219, 221, 568; 215/227, 228, 316; 220/254.1, 254.7, 254.8, 521
See application file for complete search history.

(56) References Cited

U.S. PATENT DOCUMENTS 3,156,369 A 11/1964 Bowes et al.
3,968,872 A 7/1976 Cavazza
(Continued)

FOREIGN PATENT DOCUMENTS

JP 07022980 U 4/1995
JP 7223681 A 8/1995
(Continued)

OTHER PUBLICATIONS

PCT International Search Report dated Nov. 18, 2009 for corresponding Application No. PCT/KR2009/000072.
(Continued)

*Primary Examiner* — Anthony Stashick
*Assistant Examiner* — Madison L Poos
(74) *Attorney, Agent, or Firm* — Westman, Champlin & Koehler, P.A.

(57) ABSTRACT

A bottle cap that is an apparatus for containing heterogeneous materials, applied in the discharge direction of materials in a container, comprises: a main body coupled to a bottle neck; and a containing unit assembled inside the main body with a storage space. An activated unit is assembled in the center of the upper support unit of the main body. An activation unit for downward movement is coupled to the activated unit so that the activated unit may move downward by a separate activation unit. An opening/closing unit is coupled with the lower part of the activated unit with the above structure in order to seal an opening/closing hole of the storage space.

24 Claims, 24 Drawing Sheets

(51) Int. Cl.

| | |
|---|---|
| ***B65D 47/12*** | (2006.01) |
| ***B65D 47/20*** | (2006.01) |
| ***B65D 47/24*** | (2006.01) |
| ***B65D 47/30*** | (2006.01) |
| ***B65D 49/04*** | (2006.01) |
| ***B65D 51/00*** | (2006.01) |
| ***B05B 11/00*** | (2006.01) |
| ***B65D 41/50*** | (2006.01) |

(52) U.S. Cl.

CPC ..... *B65D 47/0838* (2013.01); *B65D 47/12* (2013.01); *B65D 47/127* (2013.01); *B65D 47/2006* (2013.01); *B65D 47/243* (2013.01); *B65D 47/305* (2013.01); *B65D 49/04* (2013.01); *B65D 51/002* (2013.01); *B65D 51/2828* (2013.01); *B65D 51/2835* (2013.01); *B65D 51/2842* (2013.01); *B65D 51/2864* (2013.01); *B65D 51/2892* (2013.01)

(56) References Cited

U.S. PATENT DOCUMENTS

| | | | |
|---|---|---|---|
| 4,793,475 | A | 12/1988 | Itzel |
| 5,038,684 | A | 8/1991 | Petrovich |
| 5,038,951 | A | 8/1991 | Rizzardi |
| 6,148,996 | A | 11/2000 | Morini |
| 6,644,471 | B1 | 11/2003 | Anderson |
| 7,055,684 | B2 | 6/2006 | Anderson |
| 7,055,685 | B1 | 6/2006 | Patterson et al. |
| 7,210,575 | B2 | 5/2007 | Oswald |
| 7,279,187 | B2 | 10/2007 | Daniels et al. |
| 7,562,782 | B2 | 7/2009 | Yorita |
| 7,854,104 | B2 | 12/2010 | Cronin et al. |
| 8,083,055 | B2 | 12/2011 | Simonian et al. |
| 8,328,010 | B2 | 12/2012 | Lee et al. |
| 8,336,706 | B2 | 12/2012 | Lee et al. |
| 8,418,865 | B2 | 4/2013 | Cho |
| 8,485,353 | B2 | 7/2013 | Lee et al. |
| 2005/0279653 | A1 | 12/2005 | Williams-Lucas et al. |
| 2013/0112646 | A1 | 5/2013 | Cho |
| 2014/0166510 | A1* | 6/2014 | Frutin ..... B65D 51/2864 206/221 |

FOREIGN PATENT DOCUMENTS

| | | | |
|---|---|---|---|
| JP | 09124041 | | 5/1997 |
| JP | 9202331 | A | 8/1997 |
| JP | 10059373 | A | 3/1998 |
| JP | 2002539039 | A | 11/2002 |
| JP | 3432533 | B | 5/2003 |
| JP | 2004309535 | A | 11/2004 |
| JP | 2007276786 | | 10/2007 |
| JP | 2008030838 | A | 2/2008 |
| KR | 1020040023922 | | 5/2004 |
| KR | 20070062383 | A | 6/2007 |
| WO | 9838104 | | 9/1998 |
| WO | 2007069845 | A1 | 6/2007 |
| WO | 2007111463 | A2 | 10/2007 |
| WO | 2010044515 | A1 | 4/2010 |

OTHER PUBLICATIONS

Prosecution history for corresponding U.S. Appl. No. 13/517,401, filed Jul. 23, 2012 including: Notice of Allowance dated Mar. 28, 2014; Amendment dated Dec. 2, 2013 and Office Action dated Sep. 9, 2013.

* cited by examiner (A)

[FIG.16]
(B)

BOTTLE CAP

CROSS-REFERENCE TO RELATED APPLICATION

This Application claims priority to U.S. Application 13/517,401, which was a section 371 National Stage Application of International Application No. PCT/KR2009/000072, filed Jan. 7, 2009 and published as WO 2010/044515 on Apr. 22, 2010, in Korean, the contents of which are hereby incorporated by reference in their entirety.

TECHNICAL FIELD

The present invention relates to a bottle cap which showing a structure of a containing part received within a heterogeneous material containing device.

BACKGROUND ART

There are related arts such as PCT Patent Application No. WO 98/38104, Korean Patent Application No. 10-2004-0023922, Japanese Patent Application No. P2004-309535, Japanese Utility-model Laid-open Application No. 7-22980, and U.S. Pat. Nos. 7,279,187, 3,156,369, 3,968,872, 5,038,951, 6,148,996, 6,644,471, 7,055,684, and 7,055,685, and Japanese Patent Registration No. 3,432,533 (Sep. 10, 1992) and PCT Patent Application Nos. WO2007/069845, WO2007/111463 (see FIG. 20), which are issued by the inventor of the present invention.

Among these, a related art disclosed in PCT Patent Application No. WO 98/38104 has following problems. Referring to FIG. 1, a bottle neck should be remolded to prevent a containing part from idling when a cap is rotated. Also, referring to FIG. 4, a containing part is fitted into the bottle neck to prevent the containing part from idling, and thus, it is difficult to realize normal capping because an excessive force is required when a cap is capped onto the bottle neck.

Also, Japanese Patent Application No. P2004-309535 discloses a technology in which a sealing part formed of an aluminum thin film is broken when a foldable button is pushed to drop and mix contents within a containing part into a container. The above-described technology was disclosed in Japanese Patent Registration No. 3,432,533 (Sep. 10, 1992) and Korean Patent Application No. 10-2004-0023922, issued by the inventor of the present invention.

Korean Patent Application No. 10-2004-0023922 discloses a technology in which a foldable part is broken when an upper foldable button of a bottle cap is pushed, and simultaneously, contents within a containing part are dropped and mixed into a container. However, there are problems that the containing part is limitedly expanded in volume, and it is difficult to break a sealing part which seals a lower side of the containing part.

Also, Japanese Utility-model Laid-open Application No. 7-22980 discloses a technology in which a lower sealing part of a containing part is pushed or a cut-out film is separated when an upper foldable button of a bottle cap is pushed. However, the technology in which the sealing part and the cut-out film are separated and dropped into a container is undesirable in safety.

U.S. Pat. Nos. 7,279,187, 3,156,369, 3,968,872, and 5,038,951 disclose a technology in which a sealing part is opened by pushing a containing part using a user's hand. However, this technology is previously well-known technology. Also, there are problems that sealing with respect to an inner storage space of the containing part is reduced, and a thin cutting line is formed to break a lower sealing part when the containing part is pushed, thereby reducing barrierability due to the thin cutting line.

U.S. Pat. No. 7,055,684 discloses a modified technology of that disclosed in U.S. Pat. No. 5,038,684. However, the technology disclosed in U.S. Pat. No. 7,055,684 does not solve the above-described problems.

Alternatively, although U.S. Pat. No. 6,644,471 is disclosed, a technology disclosed in U.S. Pat. No. 6,644,471 does not absolutely solve the barrierability.

Also, although a technology in which, when a bottle cap is rotated or opened, contents within a storage space of a containing part are dropped while the containing part descends. However, the technology is different from that as set forth in the present invention in view of the idea and technical features of the present invention.

Also, although a technology in which a containing part is separately manufactured to expand an internal volume of the containing part, and the containing part is sealed to improve preservability of a sealing part is disclosed PCT Patent Application Nos. WO2007/069845 and WO2007/111463 (see FIG. 20) issued by the inventor of the present invention, the technology is different from that as set forth in the present invention in view of a technical idea.

DISCLOSURE OF THE INVENTION

Technical Problem

To solve the above-described problems, an object of the present invention is to provide a re-sealing prevention unit for preventing a heterogeneous material from illegally injecting into a containing part after heterogeneous materials within the containing part are dropped and mixed into a container.

Another object of the present invention is to provide a bottle cap in which a separate unit for discharging the mixed contents is additionally provided above a main body of the bottle cap so that the bottle cap is easily used without taking the bottle cap out of a neck of a container.

Also, the storage space of the containing part within the bottle cap is provided in plurality, and thus, various contents suitable for consumer's tastes can be stored in the storage spaces.

Technical Solution

In one embodiment, a bottle cap coupled or assembled in a direction in which a content with a container is discharged includes: a main body assembled with a neck of the container; and a containing part having a storage space coupled inside the main body, wherein an operated part for sealing a lower space of the storage space within the containing part is coupled in the center of a main body spout of the main body.

Also, an operation part may be coupled in the center of the main body spout of the main body including the operated part, and when the operation part is rotated, the operated part may descend to open the storage space, thereby dropping and mixing heterogeneous materials into the container.

Also, a unit for discharging the mixed contents within the container may be provided to the operation part of the bottle cap, and preferably, a push pull-up (PP) cap may be provided, or an auxiliary cover including a connection part having a hinge shape, a pump dispenser, or a rubber plug for discharging the mixed contents by inserting a syringe into the operated part may be provided.

According to an aspect, a pump dispenser or a metering box serving as a metering cup may be additionally provided to an operated part sealing a storage space of a containing part coupled in the center of the inside of a main body spout of a main body to discharge mixed contents in addition to the mixing of the contents within the container.

According to another aspect, a storage space may be defined in a containing part assembled inside a main body, and an auxiliary space may be defined between the main body disposed above the storage space and an operated part, thereby providing the plurality of storage spaces.

According to further another aspect, the other auxiliary space may be defined under an opening part, i.e., under a storage space of a containing part.

According to further another aspect, a button part including a foldable part may be disposed inside a main body spout of a main body, and when the button part is pressed, the storage space of the containing part is opened. As necessary, a pump dispenser or various discharge members may be provided to the button part as a unit for discharging mixed contents within a container.

According to further another aspect, a plurality of storage spaces may be provided within a main body of a bottle cap, and preferably, an auxiliary space may be defined under a button part, and a storage space defined by assembling a container part may be defined under the auxiliary space.

Advantageous Effects

Highly pure liquid or power may be separately stored in the inner storage space, and then may be immediately mixed for using as necessary. Thus, fresh contents may be provided always when the user drinks the contents. Alternatively, the mixed contents may be discharged through the separate discharge unit without taking the bottle cap out of the container.

BRIEF DESCRIPTION OF THE DRAWINGS

FIGS. 1 to 5 are views of a bottle cap according to a first embodiment of the present invention, wherein FIG. 1 is a cross-sectional view of the bottle cap, FIG. 2 is a cross-sectional view illustrating a structure in which a discharge member is disposed above an operation part constituting the bottle cap, FIG. 3 is a cross-sectional view illustrating a structure in which an openable auxiliary cover connected to a connection part is disposed above the operation part constituting the bottle cap, FIG. 4 is a cross-sectional view illustrating a structure in which an openable discharge member is disposed above the operation part constituting the bottle cap, and FIG. 5 is a cross-sectional view illustrating a structure in a pump dispenser is disposed above the operation part constituting the bottle cap.

FIGS. 6 to 9 are views of a bottle cap according to a second embodiment of the present invention, wherein FIG. 6 is a cross-sectional view illustrating a structure in which an rubber plug is disposed above an operated part constituting the bottle cap so that contents mixed within a container are extracted through a syringe, FIG. 7 or 9 is a cross-sectional view illustrating a structure in which a metering space for metering the contents mixed within the container to discharge the contents is defined, and FIG. 8 is a cross-sectional view illustrating a structure in which a pump dispenser for discharging the contents mixed within the container is mounted.

FIGS. 10 to 15 are cross-sectional views of a bottle cap according to another embodiment of the present invention, wherein FIG. 10 is a cross-sectional view illustrating a structure in which an auxiliary space is defined between an inner storage space of the main body and an operated part to provide the plurality of storage spaces, FIGS. 11 and 12 are views illustrating modified examples of the auxiliary space, FIG. 13 is a cross-sectional view illustrating a structure in which the other auxiliary space is defined under the inner storage space of the main body, FIG. 14 is a cross-sectional view illustrating a structure in which the other auxiliary space is defined in the operated part that is a unit for opening the storage space, and FIG. 15 is a cross-sectional view illustrating a structure in which a plurality of storage spaces are defined between a lower portion of a top surface of the main body and an opening part to open the storage spaces while the operated part descends.

FIGS. 16A and 16B are views of a bottle cap according to further another embodiment of the present invention, wherein FIG. 16A is a cross-sectional view illustrating a structure in which an opening part is opened while an operated part is elevated upward by a separate operation part, and FIG. 16B is a longitudinal sectional view illustrating a main part in a structure in which a button part is elevated upward by the separate operation part.

FIGS. 18 to 21 are views of a bottle cap according to further another embodiment of the present invention, wherein FIG. 18 is a cross-sectional view illustrating a structure in which a pump dispenser is disposed above the button part, FIG. 19 is a cross-sectional view illustrating a structure in which a discharge member for assisting discharge of mixed contents is provided, FIG. 20 is a cross-sectional view illustrating a structure in which a metering space for assisting the discharge of the mixed contents is defined, and FIG. 21 is a cross-sectional view illustrating a structure in which a rubber plug is coupled to the button part so that the contents mixed within a container are extracted through a syringe.

FIGS. 22 to 23 are views of a bottle cap according to further another embodiment of the present invention, wherein FIG. 22 is a cross-sectional view illustrating a structure in which an auxiliary space is defined above/under an inner storage space of a main body, and FIG. 23 is a cross-sectional view illustrating a structure in which the other auxiliary space is defined under a button disposed above the storage space.

FIGS. 24 and 25 are views of a bottle cap according to further another embodiment of the present invention, wherein FIG. 24 is a cross-sectional view illustrating a structure in which a discharge member is disposed directly above an operated part, and FIG. 25 is a longitudinal sectional view illustrating a structure in which a button part is openable by an operation part that is a separate auxiliary unit.

BEST MODE FOR CARRYING OUT THE INVENTION

Figure 1:
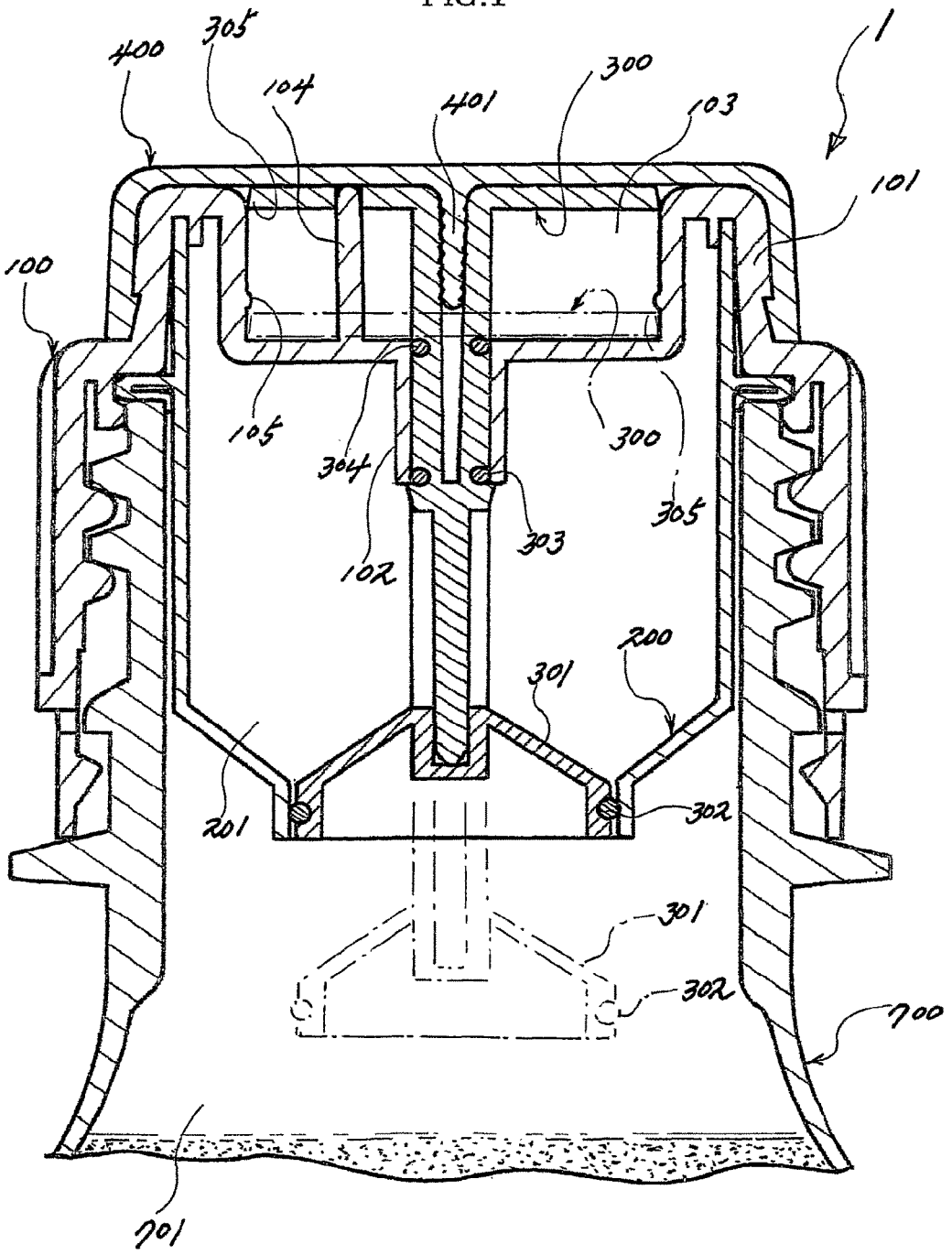

Exemplary embodiments of the present invention will now be described with reference to the accompanying drawings.

In a bottle cap 1 in which heterogeneous materials are contained, a main body 100 coupled in a content discharge direction of a container 700 and an assembly-type containing part 200 having a storage space 201 within the main body 100 are coupled to each other. Also, an operated part 300 (that is a part operated by an operation part) extending toward the storage space 201 of the containing part 200 is coupled to a central portion of an upper main body spout 101 of the main body 100.

The operated part 300 includes an opening part 301 having a sealing ring 302 for sealing an opening hole defined in a lower side of the storage space 201. Also, sealing rings 303 and 304 are coupled to the operated part 300 disposed inside a support part 102 of the upper main body 100 to maintain air-tightness between the storage space 201 and the operated part 300.

Also, to allow the operated part 300 to open the opening hole of the storage space 201, an operation part 400 for applying a force into the operated part 300 is coupled to a center of the main body spout 101. When the operation part 400 is rotated, since a descending operation part 401 has a stepped shape, a tilted shape, or a screw shape, the operated part 300 descends downward.

Preferably, when the operation part 400 is rotated in a state where a groove or long protrusion is disposed in/or an inner wall of the space 103 and a circular brim 305 of the operated part 300 is disposed on a portion corresponding to that of the groove or long protrusion, or the operated part 300 is fitted into a lengthily protruding guide 104, the operated part 300 may descend by the guide 104 without being rotated.

An operation and effect of the bottle cap 1 according to the present invention will be described below.

When the operation part 400 is rotated in the state of FIG. 1, the descending operation part 401 pushes the operated part 300 downward. In this process, the opening part 301 gets out of an opening hole of the containing part 200, and a content within the storage space 201 is dropped and mixed into the space 701 of the container 700.

Also, when the operation part 400 is rotated, the circular brim 305 of the operated part 300 is hooked (on a portion shown in a dot line) on a stopper 105 disposed in a lower side of the space 103 of the main body 100. Thus, the operated part 300 does not descend ever and is stopped.

Also, after the container 700 is shaken to further mix the contents within the space 701 in the above-described state, the bottle cap 1 is removed from the container 700 to discharge the mixed contents.

Figure 2:
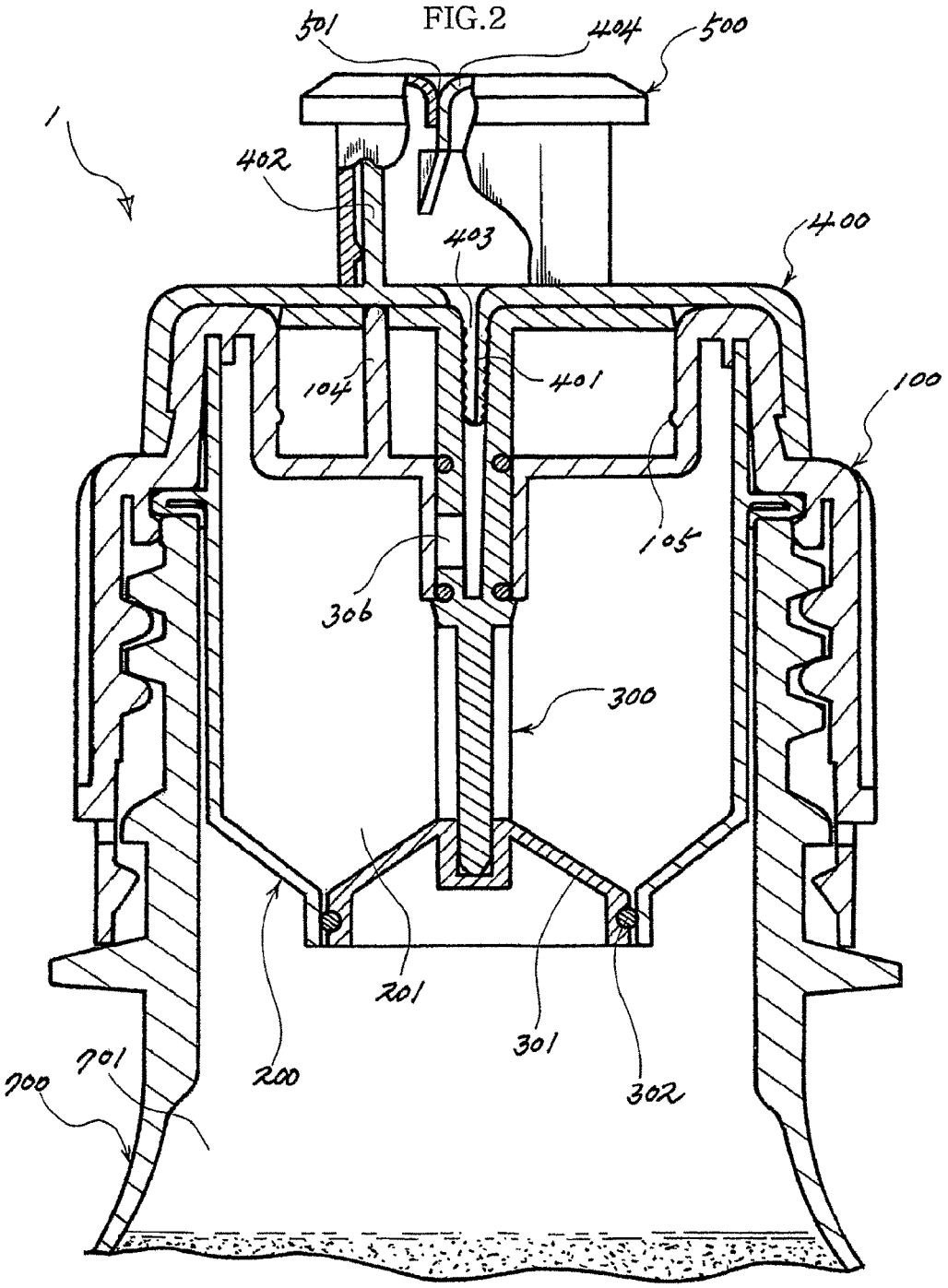

According to another embodiment (see FIG. 2), as shown in FIG. 1, a content within a storage space 201 is mixed into a container 700, and the mixed contents are discharged without taking a battle cap 1 off. This is done because an openable discharge member 500 is assembled in the center of a center of an upper operation part spout 402 of an operation part 400.

Here, when the operation part 400 is rotated, an operated part 300 descends by the descending operation part 401. In this process, the content within the storage space 201 is dropped and mixed into a container 700 through an opening. In this state, if the discharge of the mixed contents within the container 700 is required, when the container 700 is tilted in a state where a discharge member 500 ascends, the mixed contents are moved through the opening hole and a first discharge hole 306, and then discharged through a discharge hole 501 spaced from a discharge hole sealing part 404 via a second discharge hole 403.

Figure 3:
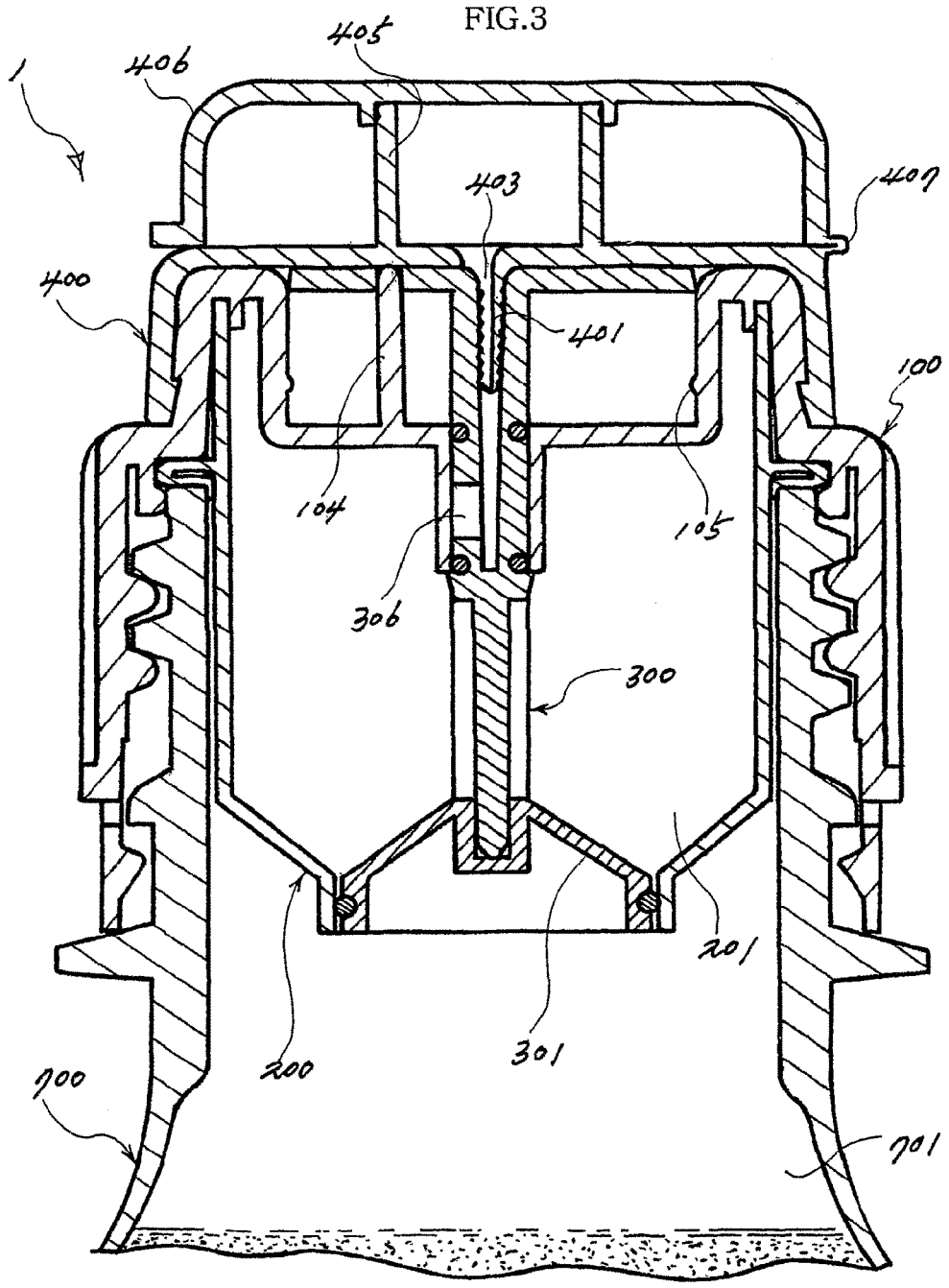

According to further another embodiment (see FIG. 3), mixed contents within a container 700 may be discharged into an operation part 400 through an operation part spout 405. Also, to sanitation of the operation part spout 405, an auxiliary cover 406 for protecting the operation part spout 405 may be connected using a connection part 407.

Here, after the operation part 400 is operated to drop and mix the content within a storage space 201 into an inner space 701 of the container 700, when an auxiliary cover 406 is opened and the container 700 is laterally tilted, the mixed contents are discharged through the operation part spout 405 via a first discharge hole 306 and a second discharge hole 403.

Figure 4:
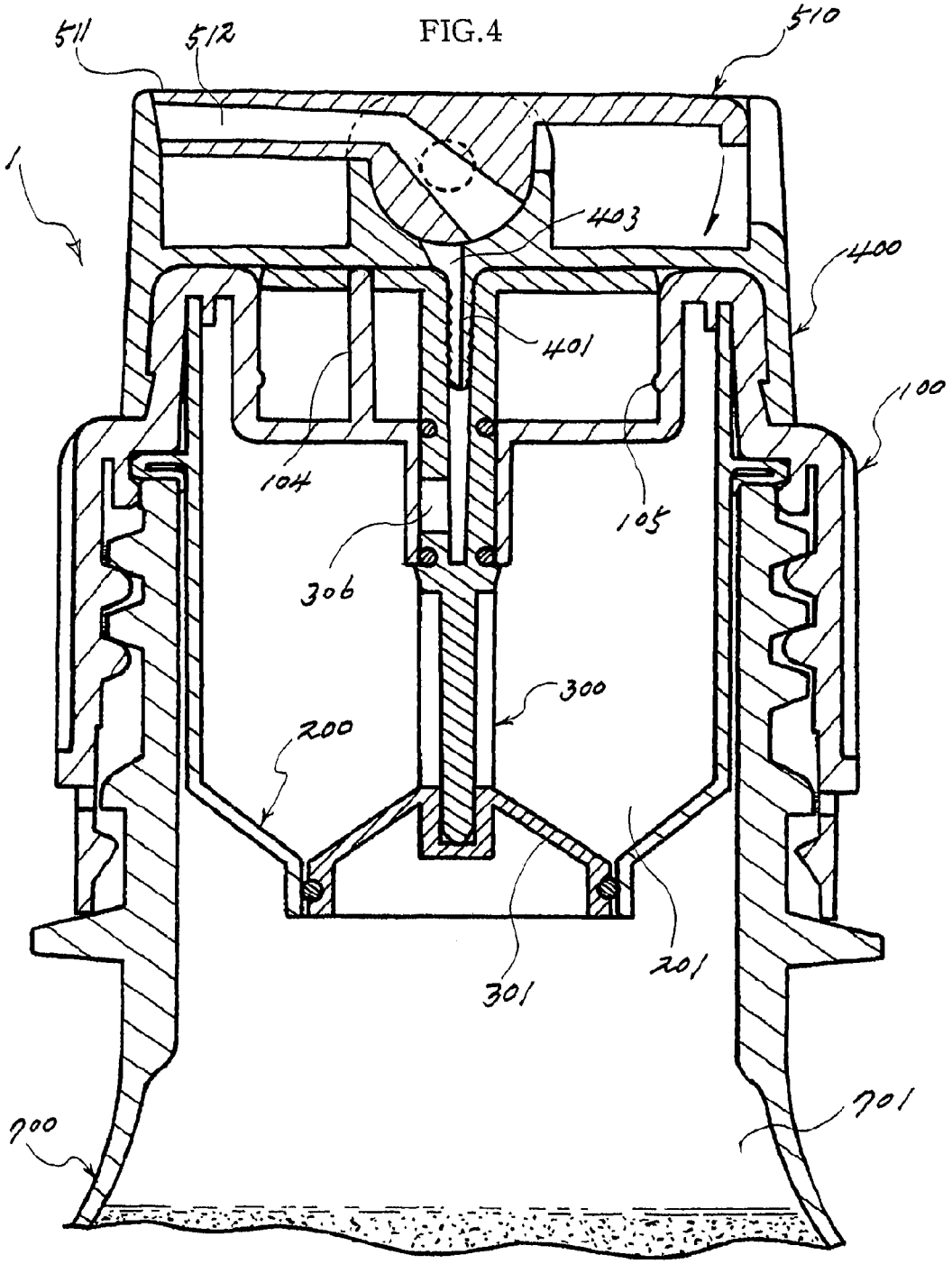

According to further another embodiment (see FIG. 4), a discharge member 510 openable at a predetermined angle is assembled with an upper portion of an operation part 400 in which a second discharge hole 403 is defined. Here, when the operation part 400 is operated to open an opening part 301 and lift a discharge member 501, a discharge hole 512 is opened while a nozzle 511 ascends.

Also, in this state, when the container 700 is laterally tilted, the mixed contents within the container 700 are discharged through a discharge hole 512 via first and second discharge holes 306 and 403.

Figure 5:
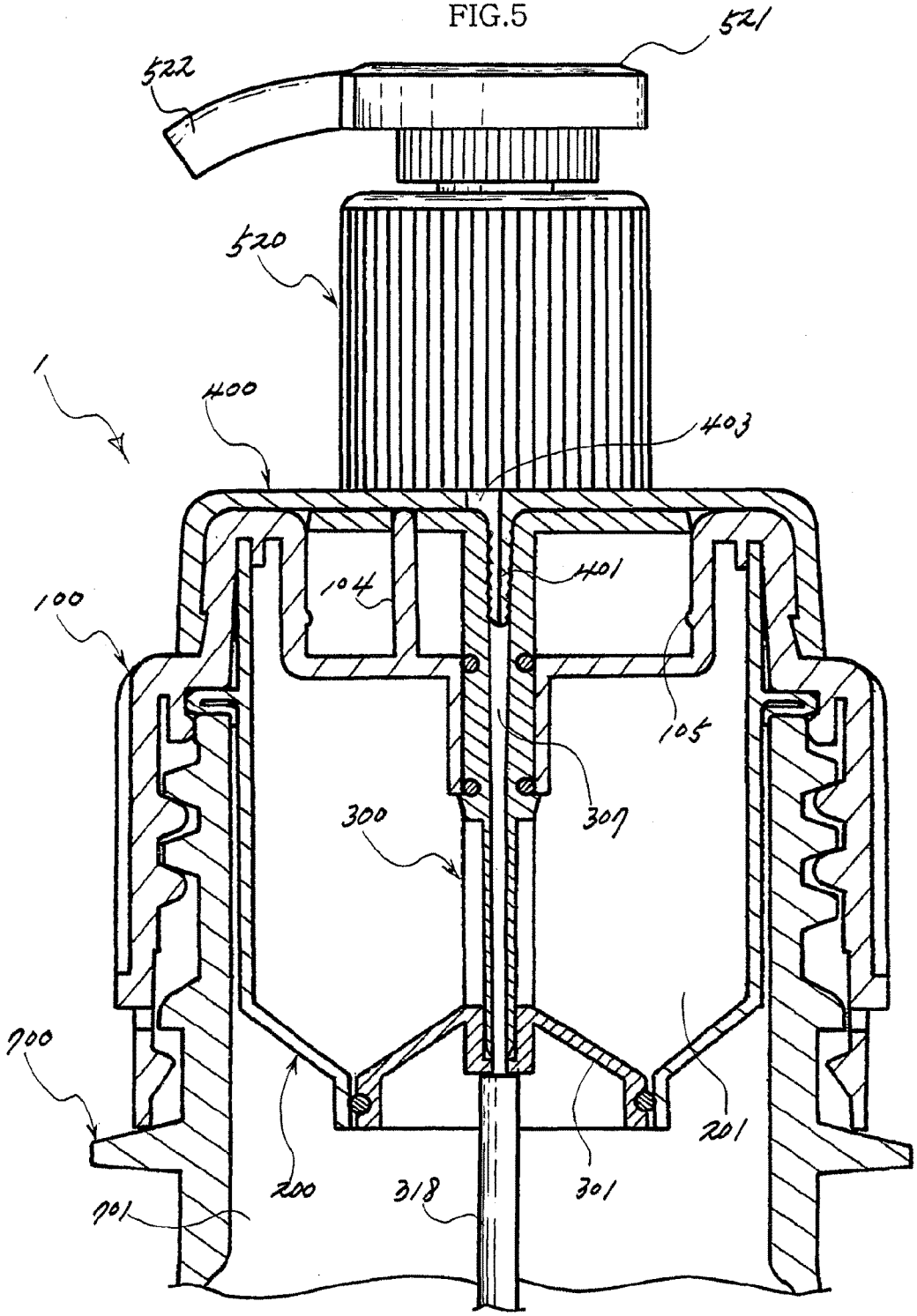

According to further another embodiment (see FIG. 5), a pump dispenser 520 is disposed on an operation part 400. Here, after the operation part 400 is rotated to open an opening part 301, when a button 521 of the pump dispenser 520 is operated, mixed contents within a container 700 pass through a discharge tube 318 first, and then are discharged through a nozzle 522 via a vertical discharge hole 307 and a second discharge hole 403.

Figure 6:
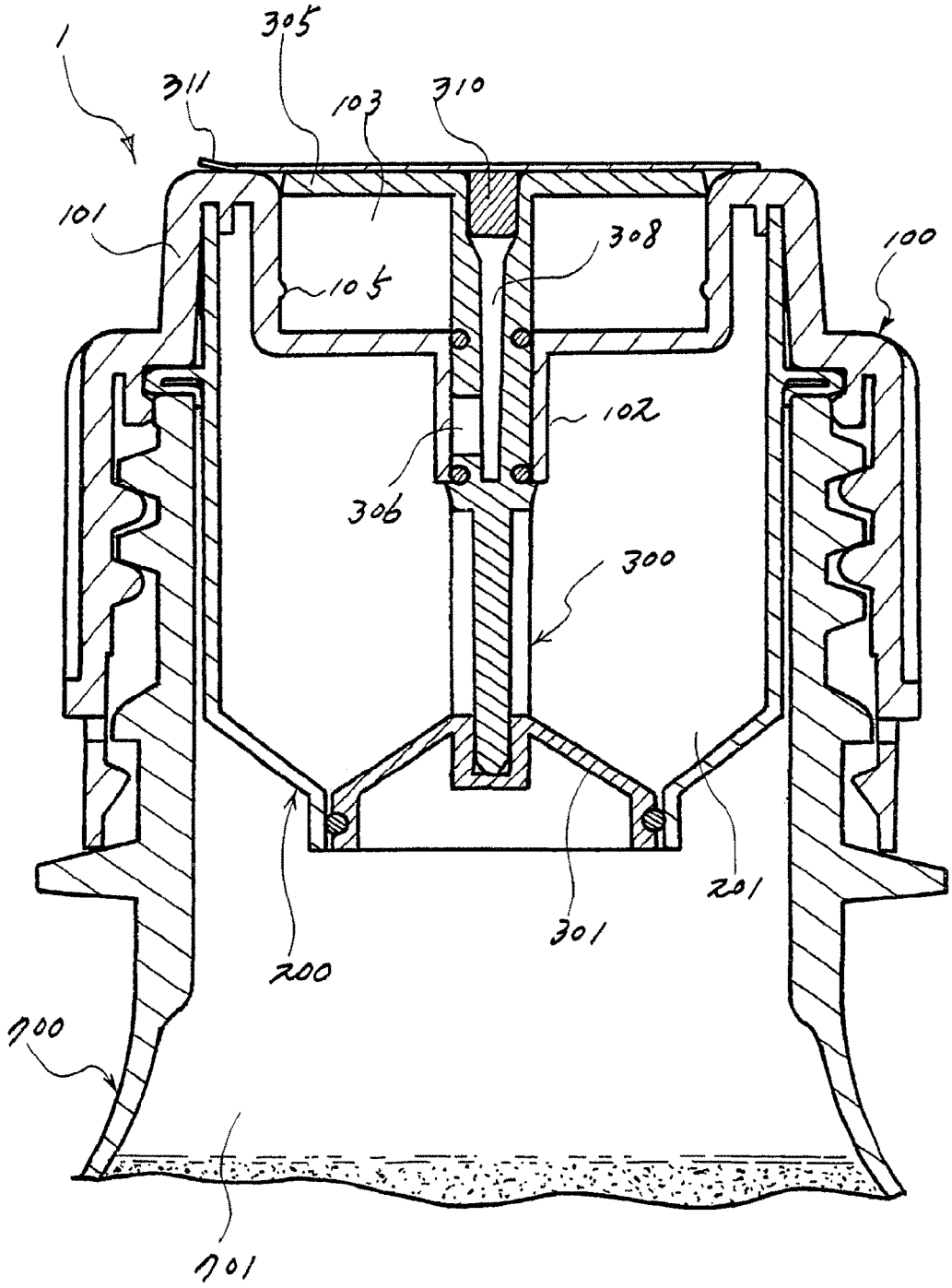

According to further another embodiment (see FIG. 6), a containing part 200 having a storage space 201 is assembled inside a main body 100. Also, an operated part 300 is disposed within the storage space 201. An opening part 301 closing an opening hole of a storage space 201 is disposed on a lower end of an operated part 300. A first discharge hole 306 within a support part 102 above the operated part 300 is sealed.

An activation plate 309 is disposed on an upper end of an inner space 103 of a main body spout 101. An end of a vertical discharge hole defined in a center of the activation plate 309 is closed by a robber plug 310, and a protection plate 311 is disposed on an upper end of a vertical discharge hole 308.

Here, when the protection plate 311 is removed and the activation plate 309 is pushed, the operated part 300 coupled in the center of a center of a support part 102 descends. In this process, the opening part 301 is opened to drop and mix the content within a storage space 201 into a container 700.

In this state, when a syringe is inserted into a rubber plug 310 to operate the syringe, the mixed contents within the container 700 are suctioned into the syringe through the first discharge hole 306 and the vertical discharge hole 308.

Also, a circular brim 305 of the activation plate 309 is hooked and fixed to a stopper 105.

Figure 7:
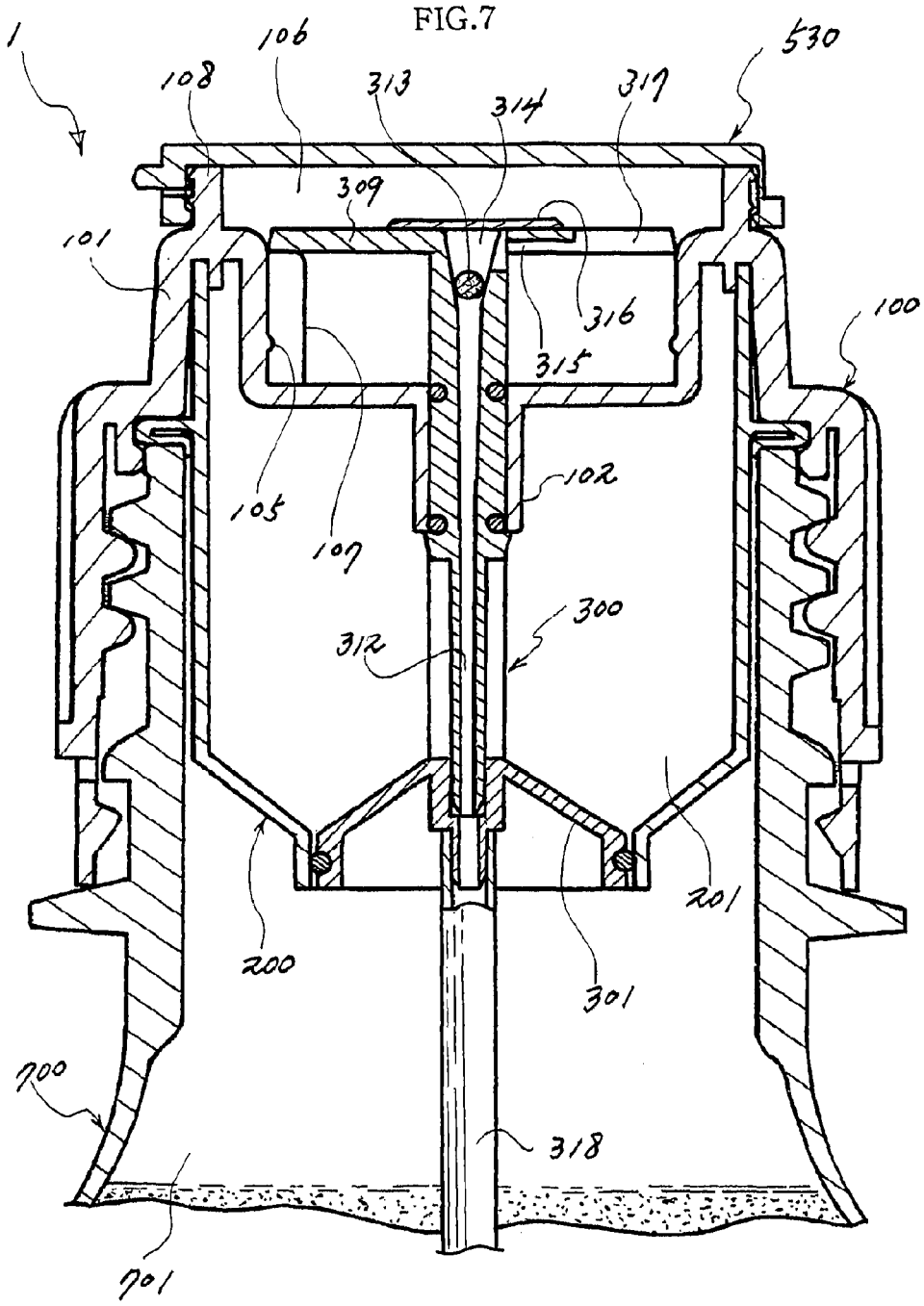

According to further another embodiment (see FIG. 7), a main body 100 is coupled to a neck of a container 700, and a containing part 200 having a storage space 201 is assembled inside the main body 100. Also, an operated part 300 supported by an inner support part 102 of the containing part 200, and an opening part 301 for closing an opening hole is disposed on a lower end of the operated part 300. Also, an activation plate 309 is hooked on an operation part stopper 107 disposed within a metering space 106.

A vertical discharge hole 312 communicating in a vertical direction is defined inside the operated part 300. Also, a ball 313 opened by only a pressure is disposed at an upper side of the vertical discharge hole 312. Also, when the ball 313 is opened, a discharge hole 314 and a lateral discharge hole 315 through which the content is movable are defined.

A sealing part 316 is disposed above the operated part 300 to prevent the discharge hole 314 from being directly opened upward and assist the lateral movement of the content. To release the formation of the operation part stopper 107 so that the operated part 300 is not pushed, but is selectively operated, a guide 317 may be disposed so that the operated part 300 is pushed after the operated part 300 is rotated with respect to a predetermined portion of the activation plate 309 to prevent a resistance from occurring.

Here, after an auxiliary cover 530 disposed above the main body 100 is separated from a main body spout 108, when the activation plate 309 is pushed, the opening part 301 is opened to drop and mix the content within the storage space 201 into an inner space 701 of the container 700.

In this state, when the container 700 is compressed, the mixed contents within the space 701 ascends through the vertical discharge hole 312 defined in the same extension line as an extending discharge tube 318 and then lift a ball 313 closing the discharge hole 314 to increase a metering space 106 by a desired amount. Also, when a pressure is not applied to the container 700, the ball 313 immediately closes the discharge hole 314 to prevent the contents within the metering space 106 from flowing again into the space 701 within the container 700.

Figure 8:
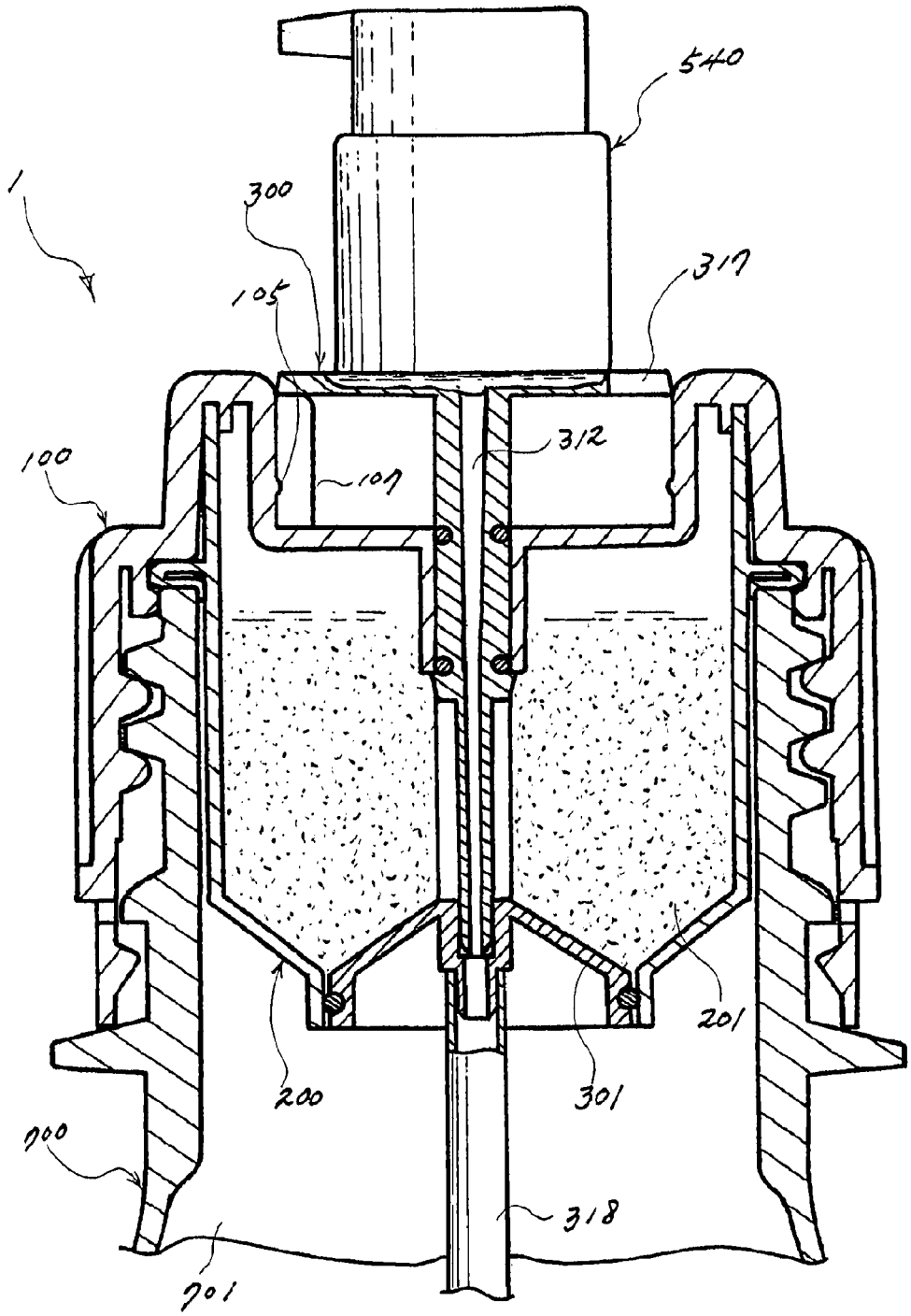

According to further another embodiment (see FIG. 8), a main body 100 constituting a bottle cap 1 and a pump dispenser 540 are provided. A pump dispenser 540 is disposed above an operated part 300 coupled to a center of the main body 100 to seal an opening hole of a storage space 201.

Here, after a guide 317 of the operated part 300 is disposed on an operation part stopper 107, when the operated part 300 together with a pump dispenser 540 is compressed, the operated part 300 descends. In this process, an opening part 301 is opened to drop and mix a content within a storage space 201 into a space 701 of a container 700.

Also, in this process, the operated part 300 is fixed to a stopper 105. In this state, when a pump dispenser 540 is operated, the mixed contents within the space 701 of the container 700 is moved first into a vertical discharge hole 312 through a discharge tube 318, and then discharged through a nozzle of the pump dispenser 540.

Figure 9:
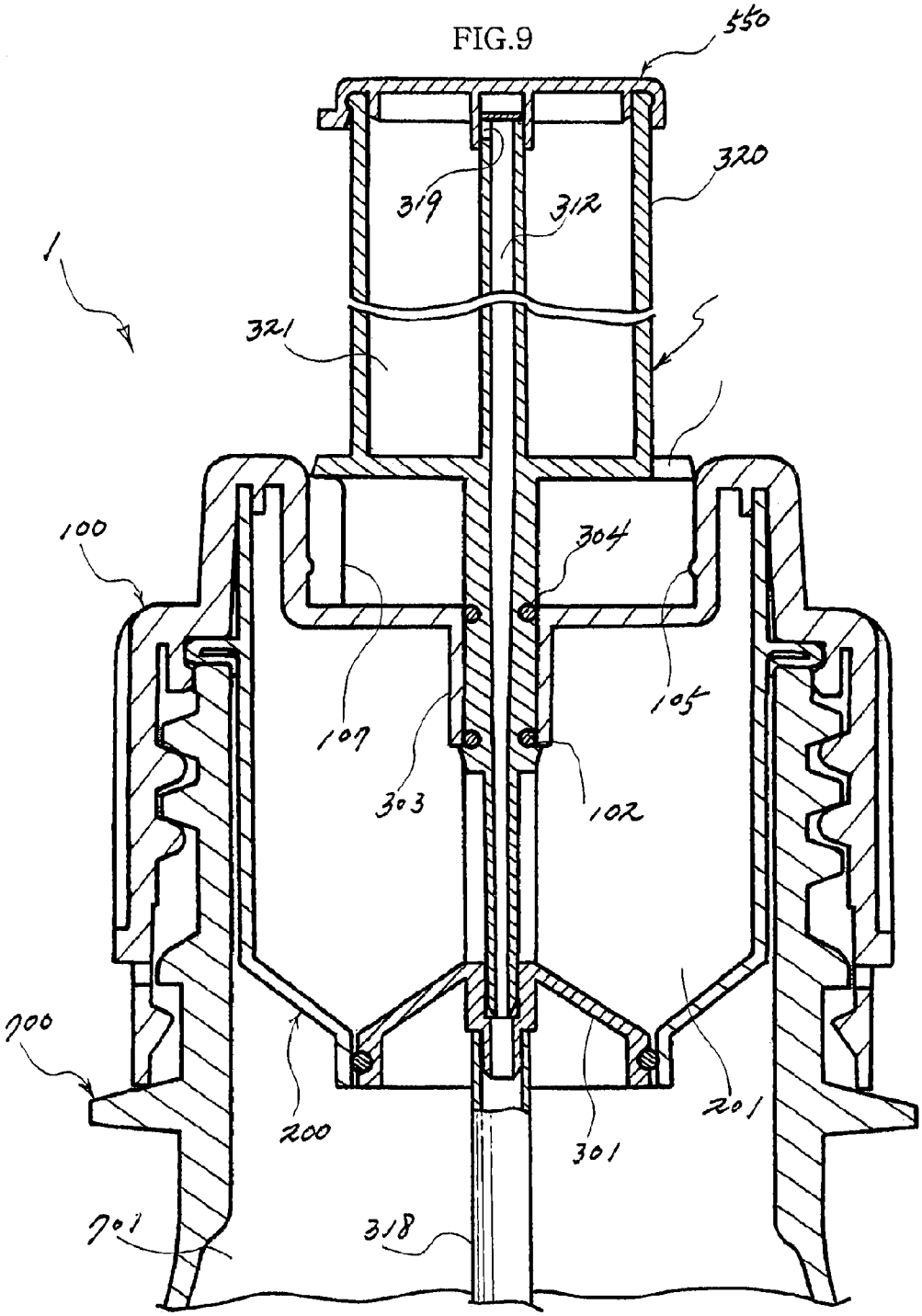

According to further another embodiment (see FIG. 9), a metering box 320 having a metering space 321 is disposed above an operated part 300. A vertical discharge hole 312 and a discharge tube 318 which are paths for moving mixed contents within a container 700 into the metering space 321 are defined in an operated part 300.

Here, the operated part 300 is fixed to a stopper 105 in a state where a guide 317 of the operated part 300 is disposed on an operation part stopper 107. Tn this process, when an opening part 301 is opened, a content within a storage space is dropped into and mixed with a content within the container 700. Thus, the container 700 is compressed to meter the mixed contents within the container 700 for a desired amount through a discharge tube 318, a vertical discharge hole 312, and a discharge hole 319 for stably discharging the mixed contents in a side direction, and then a content is moved into a metering space 321.

The content within a metering box 320 is discharged by opening a cover 550. Here, a metering gradation may be displayed on the metering box 320, or the metering box 320 may be separately manufactured and then coupled, assembled, or attached to the operated part 300. Alternatively, although the cover 550 is optionally provided, the cover 550 may be changed in design without regarding to a type such as one-touch type or a screw type.

Here, when a separate discharge unit disposed above a main body or a separate discharge unit disposed above or on the operated part 300 is provided, it is unnecessary to separate the main body from a neck of the container 700. Thus, the main body 100 may be provided to the neck of the container 700 in one touch type, a rotation type, an attachment type, or an adhesive type. As necessary, this may be applied to containers such as a cup or a can or pouch containers.

According to further another embodiment (see FIG. 10), a bottle cap 1 in which heterogeneous materials are contained has a plurality of storage spaces. For example, a containing part 200 having an inner storage space 201 of a main body 100 is assembled, and an auxiliary space 109 that is the other storage space is defined at an upper side of the main body 100 above the containing part 200.

Also, an operated part 300 coupled in the center of a support part 102 and an activation plate 322 above the operated part 300 are disposed on the auxiliary space 109 to define the auxiliary space 109 having a predetermined volume therein.

Also, in the auxiliary space 109, an outer circumference part of the activation plate 322 may be provided as an elastic stopper corresponding part 323 having a superior adhesion force. Thus, the outer circumference part of the activation plate 322 has superior air-tightness. Although the content is put into the auxiliary space 109 of the operated part 300 to seal the auxiliary space 109 using a space sealing part 324, the method for putting the content into the auxiliary space 109 may be variously changed within the idea and technical scope of the present invention.

Figure 10:
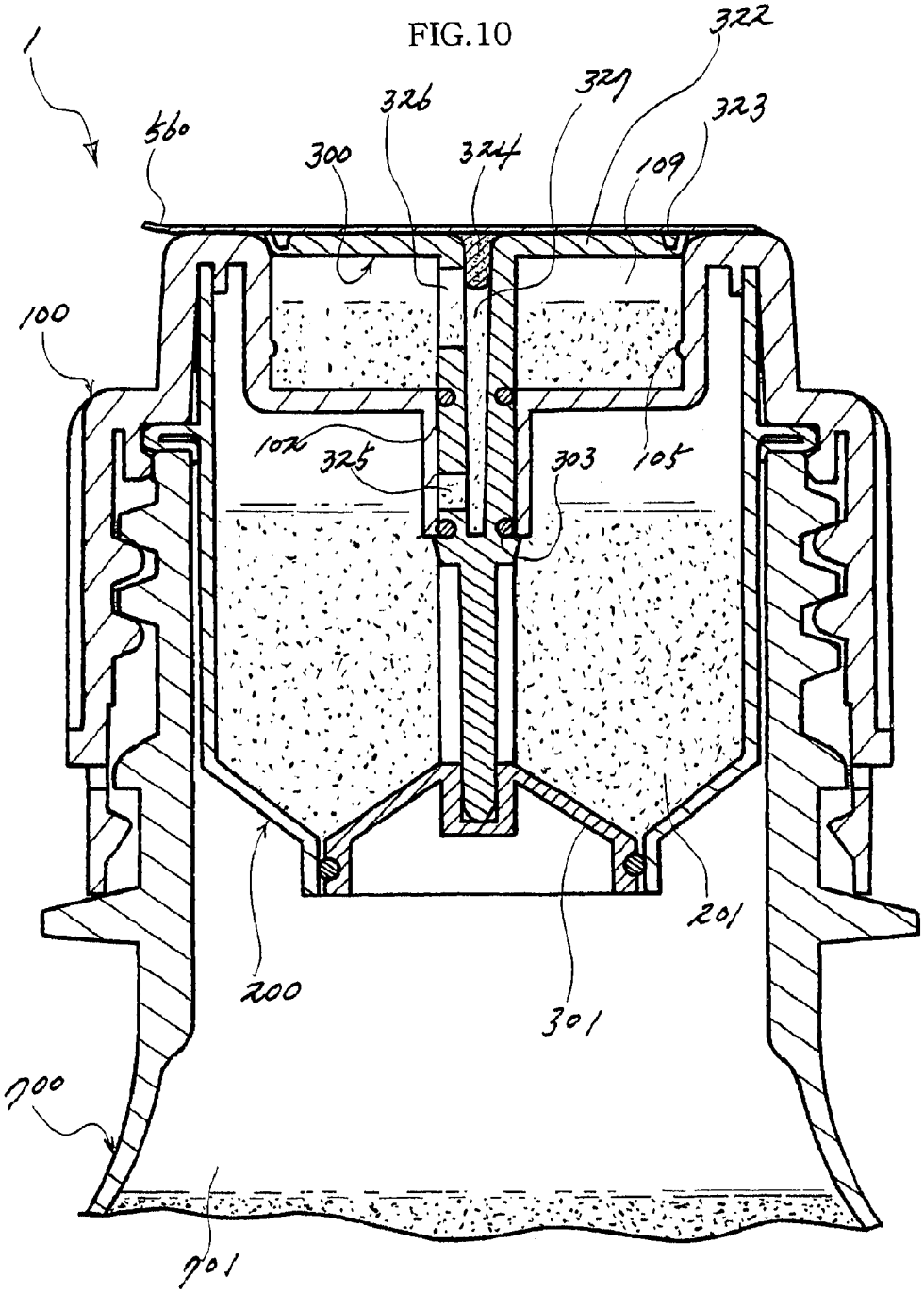

As described above, according to the operation and effect of the present invention, in the state of FIG. 10, when a protection plate 560 is moved (the protection plate 560 may be variously modified to protect the operated part 300) and the activated plate 322 is pushed, the content within the storage space 201 is dropped and mixed into an inner space 701 of the container 700 by opening an opening part 301. Also, the content within the auxiliary space 109 is dropped and mixed into the container 700 through a first discharge hole 325 via the storage space 201.

Also, as described above, when the operated part 300 is pushed, two kinds of contents are dropped and mixed into the container 700. Also, the first discharge hole 325 and a second discharge hole 326 may communicate with each other so that the content within the auxiliary space 109 is easily moved into the storage space 201.

For reference, the first discharge hole 325 may be defined by separating the storage space 201 and the auxiliary space 109 from each other by a sealing ring 303. When the first discharge hole 325 gets out of a support part 102, the content within the auxiliary space 109 is moved and mixed into the inner space 701 of the container 700 at the same time through the first discharge hole 325 via the storage space 201.

Also, the mixed contents within the container 700 may be extracted by inserting a syringe into the space sealing part 324. Here, the space sealing part 324 may be a soft robber plug.

According to further another embodiment (see FIG. 11), as a modified example of FIG. 10, when an operated part 300 is pushed, a content within an auxiliary space 109 is dropped into a storage space 201. For this, a cut-out film 110 having a cutting line may be disposed on a lower bottom surface of the auxiliary space 109, and a long protrusion 112 may be disposed above the cut-out film 110.

Figure 11:
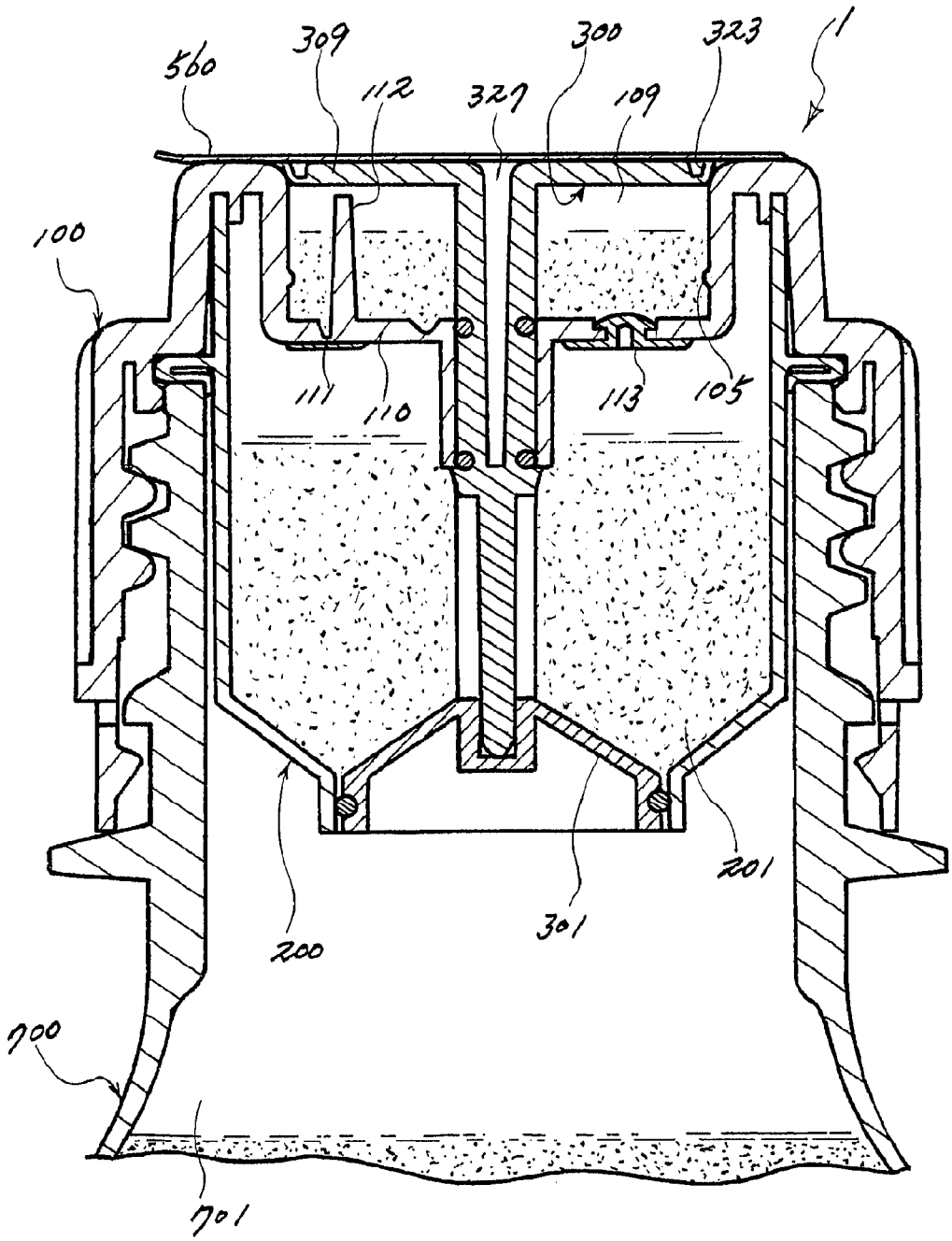

Also, as shown in FIG. 11, a separate injection hole plug 113 may be used to seal an injection hole after the content is put into the auxiliary space 109.

Here, when a protection plate 506 having various shapes is removed and an activation plate 309 is pushed, the cutting line 111 is broken by the long protrusion 112 to drop and mix the content into the storage space 201. Simultaneously, the operated part 300 descends to open an opening part 301, thereby dropping and mixing a content within a storage space 201 into a container 700.

For reference, although the cut-out film 110 is broken by the long protrusion 112, a long protrusion may be disposed at a lower portion of the corresponding activation plate 309 to break the cutting line 111, thereby opening the cut-out film 110. Preferably, the long protrusion 112 may be disposed on a top surface of the cut-out film 110 in the functional aspect.

According to further another embodiment (see FIG. 12), an injection hole 114 is defined to put a content into an auxiliary space 109, and a protection plate 115 is disposed to seal the injection hole 114, thereby sealing the auxiliary space 109.

Figure 13:
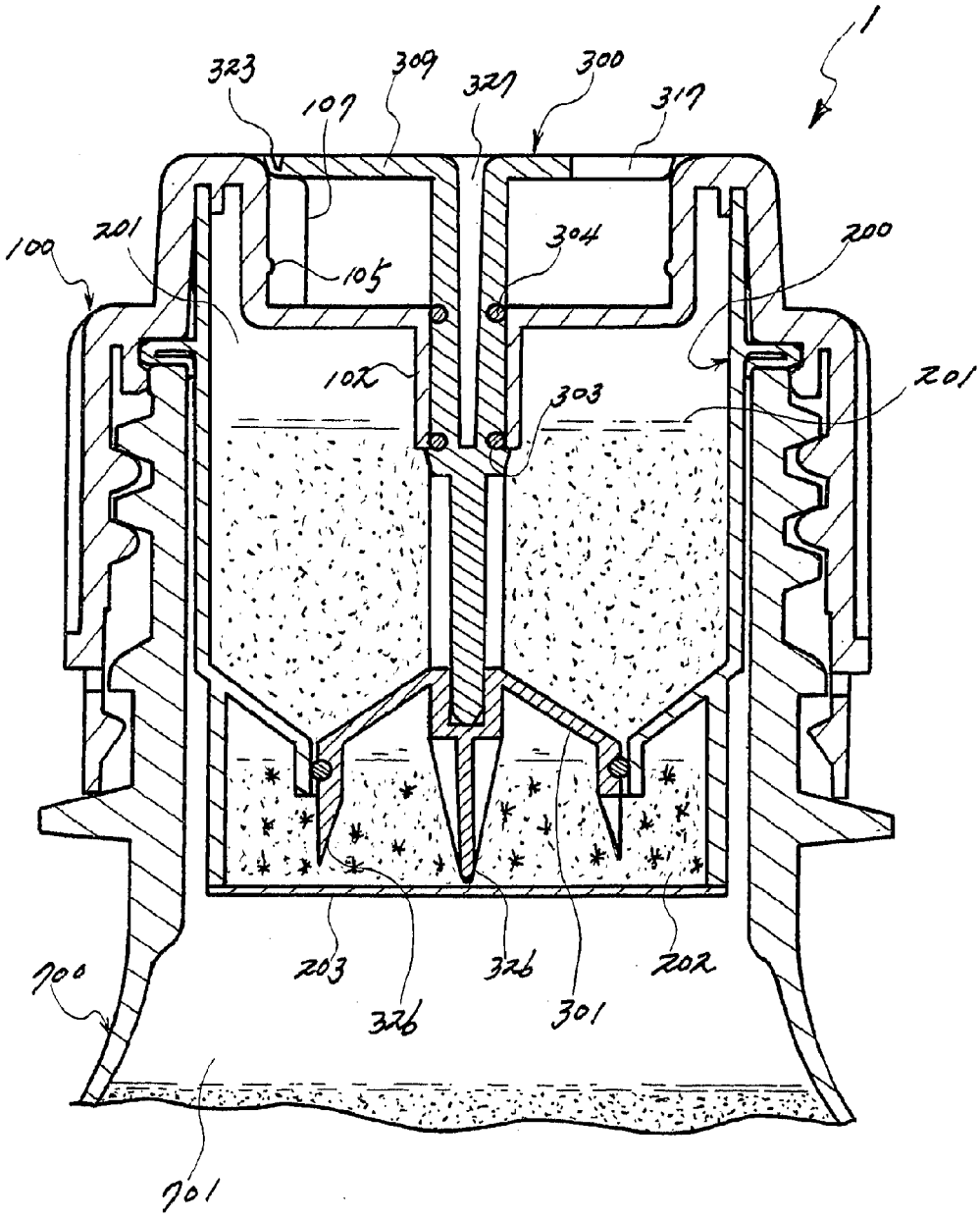

According to further another embodiment (see FIG. 13), a bottle cap 1 includes a containing part 200 having a storage space 201, a main body 100 including the containing part 200, and an operated part 300 coupled in the center of the main body 100 and the containing part 200 to seal the storage space 201 and then open the storage space 201. An auxiliary space 202 is defined under the opening part 301, and a protection plate 203 is provided to seal the auxiliary space 202.

Here, a guide 317 is disposed on an operation part stopper 107 to push an activation plate 309, thereby opening the storage space 201 and the auxiliary space 202 defined under the storage space 201. Thus, contents within the storage space 201 and the auxiliary space 202 are dropped into an inner space of a container 700 and mixed with each other.

Also, a punching pin 326 may be disposed on an opening part 301 to easily break the protection plate 203. Furthermore, a protection cover or protection plate instead of the operation part stopper 107 may be disposed on the activation plate 309 to prevent the activation plate 309 of the operated part 300 from being unnecessarily pushed.

Figure 12:
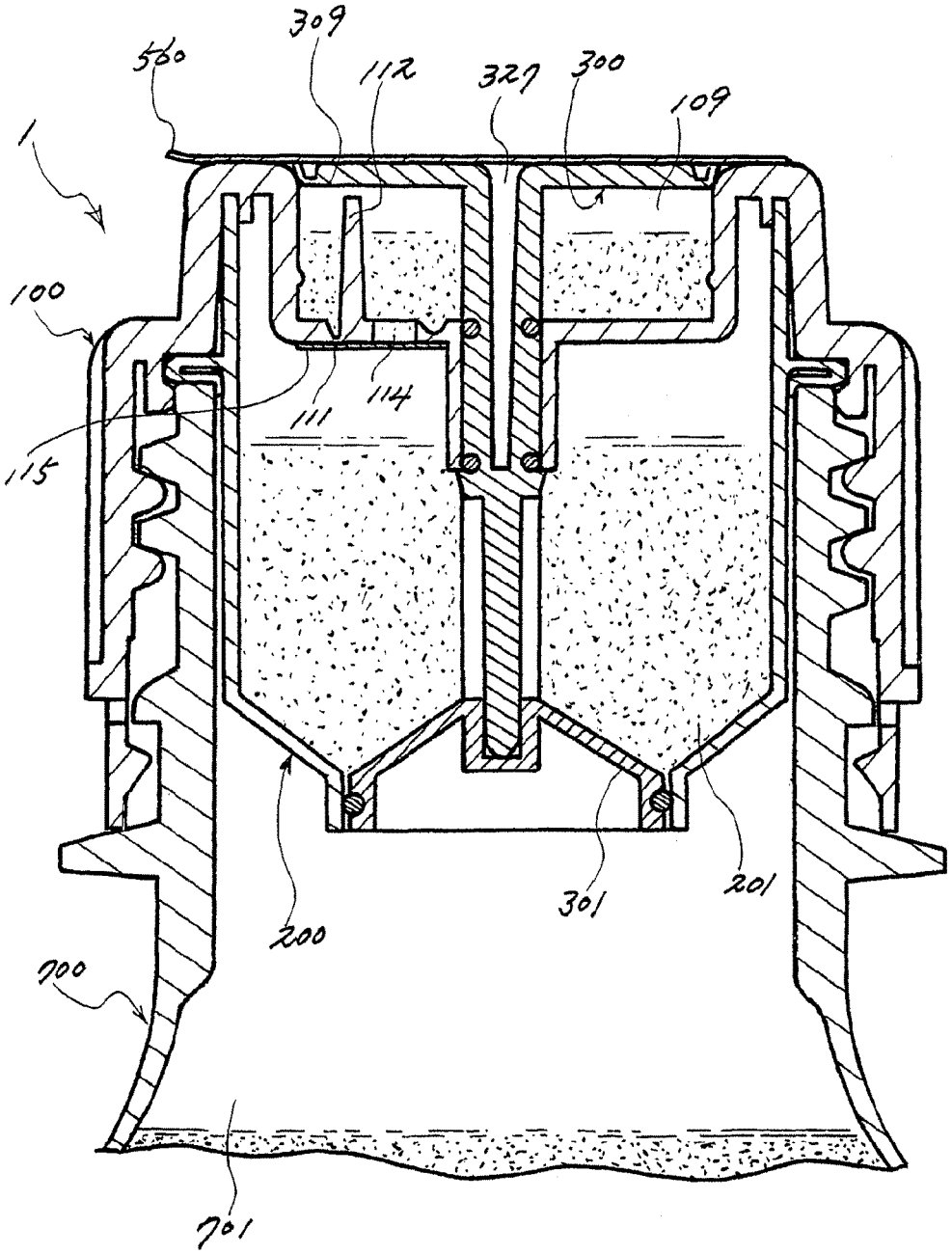

Referring to FIGS. 10, 11, and 12, an operated part 300 may descend through an operation part 400 as shown in FIG. 1. For example, a descending operation part 401 may be disposed to correspond to vertical hole 327 defined in a center of the operated part 300.

According to further another embodiment (see FIG. 14), an operated part 300 is coupled to a main body 100 including a containing part 200. When the operated part 300 is pushed, an opening part 301 closing a lower side of a storage space 201 of the containing part 200 is opened to drop and mix a content within the storage space 201. Before the operated part 300 is operated, the opening part 301 is disposed inside a support part 102 to define an auxiliary space 329.

Here, after a protection plate 560 is removed and a guide 317 is disposed on an operation part stopper, when an activation plate 309 is pushed, a discharge hole 328 gets out of a support part 102 to drop a content within an auxiliary space 329 into the storage space 201, and simultaneously, the content within the storage space 201 is dropped and mixed into an inner space 701 of a container 700 when the opening part 301 is opened.

Figure 14:
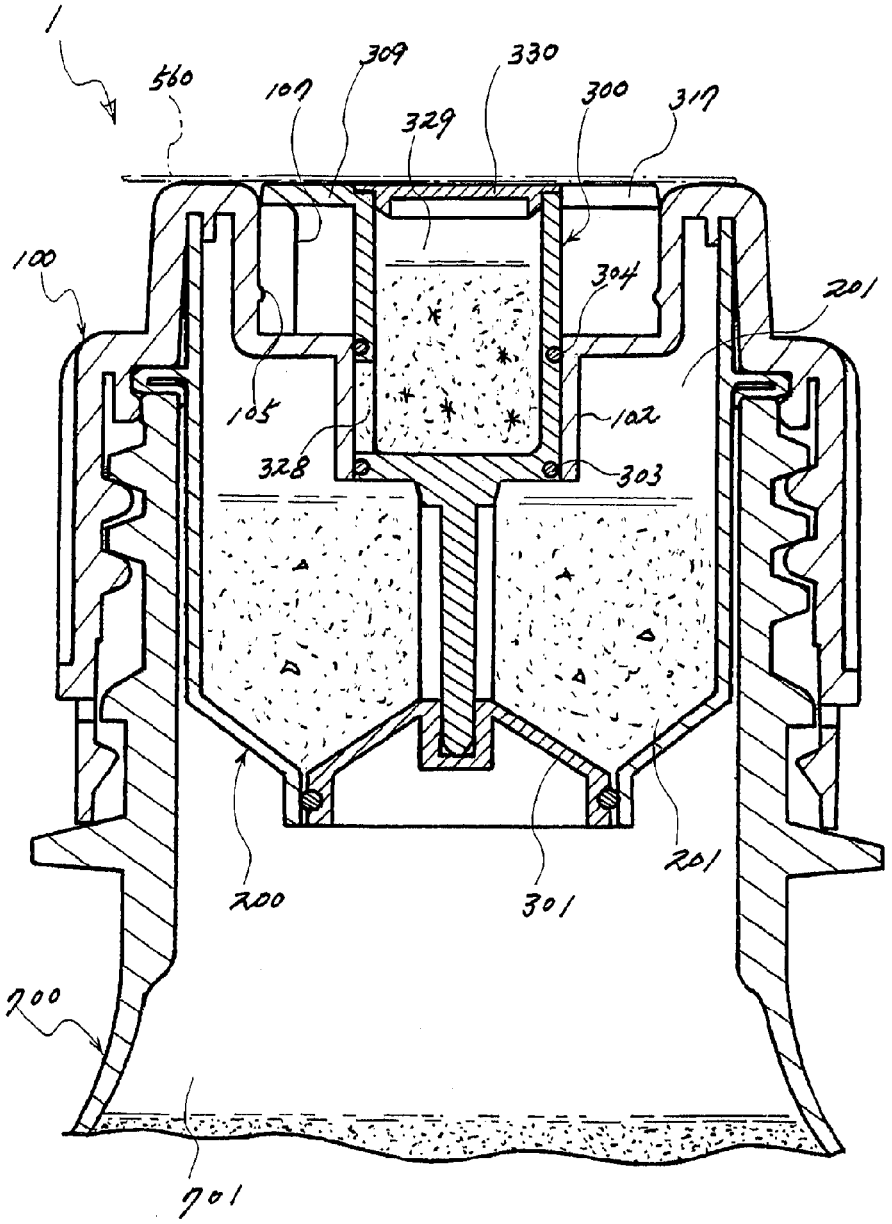

For reference, referring to FIG. 14, the operated part 300 is inserted into a center of the support part 102 to put a content into the auxiliary space 329. Then, an upper side of the auxiliary space 329 may be sealed by coupling or assembling an auxiliary space sealing plug 330 or adhering to the auxiliary space sealing plug 330, and the like.

Figure 15:
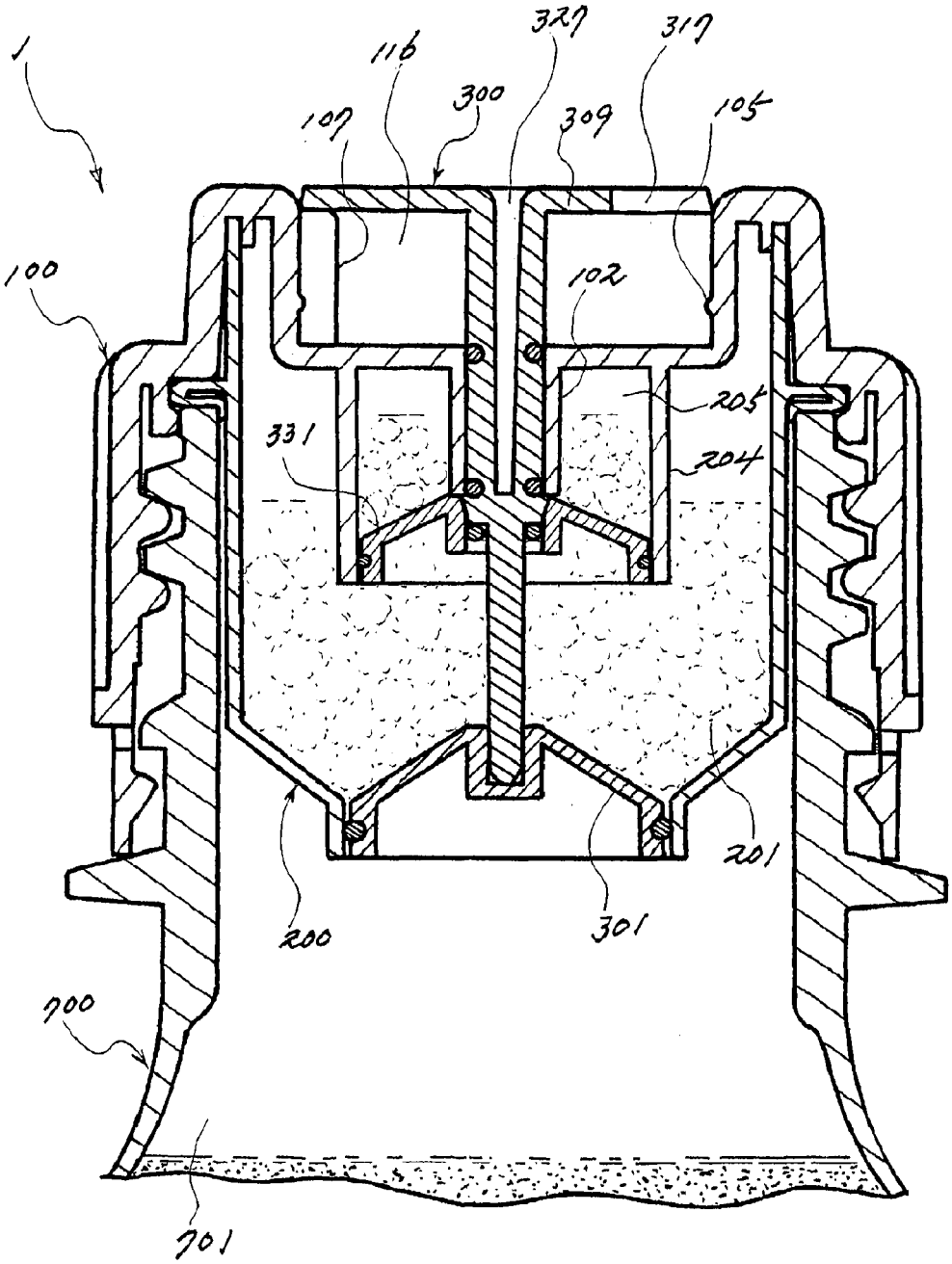

According to further another embodiment (see FIG. 15), a containing part 200 having a storage space 201 is coupled inside a main body 100. An opening hole of the storage space 201 is sealed by an opening part 301 of an operated part 300 coupled in the center of the support part 102. An operation plate 309 disposed above the operated part 300 may be protected through various methods to prevent the operation plate 309 from being randomly operated. Preferably, as shown in FIG. 14, it may prevent the operation plate 309 from being pushed by an operation part stopper 107.

An auxiliary containing part 204 is disposed above the storage space 201, i.e., in a lower side of an upper portion of the main body 100. An auxiliary space opening part 331 opened by pushing the operated part 300 is assembled inward with an inner wall of the auxiliary containing part 204.

A content is put into an inner auxiliary space 205 of the auxiliary space containing part 204 to assembly the auxiliary space opening part 331. Thereafter, the other content is put through a lower opening hole of the containing part 200 to seal the auxiliary space containing part 204 using the opening part 301.

Here, when the operation plate 309 is pressed in a state where a guide 317 of the operation plate 309 is disposed on the operation part stopper 107, the operated part 300 descends, and simultaneously, the contents within the auxiliary space 205 and the storage space 201 are dropped and mixed into an inner space 701.

Also, in this process, the operation plate 309 does not ascend by being hooked on a stopper 105. The operation plate 309 may be protected by other method, but not by the operation part stopper 107.

Also, the operated part 300 may be operated by the operation part 400 as shown in FIG. 1. For this, the descending operation part 401 of FIG. 1 is disposed on a vertical hole 327 to operate the operated part 300 by an operation of the operation part 400. As necessary, a different kind of content may be put into an upper space 116. Preferably, the guide 317 should not interrupt the air-tightness, and the operation plate 309 may include a sealing stopper corresponding part 323 as shown in FIG. 12.

For reference, as described above, maximum three spaces for containing heterogeneous materials may be provided as necessary. Also, as necessary, the other auxiliary containing part may be disposed outside the auxiliary container part 204.

According to further another embodiment (see FIG. 16A), in a bottle cap 1 of the present invention, when an operation part 400 is reversely rotated, an operated part ascends upward. Thus, an opening part 301 ascends to open an opening hole.

Also, in the bottle cap 1 of the present invention, a main body 100 is coupled to a container 700. A containing part 200 having a storage space 201 is assembled inside the main body 100. An opening hole of the containing part 200 is sealed by an opening part 301. The opening part 301 is assembled with an end of an operated part 300.

Preferably, the operated part 300 is coupled in the center of a support part 102 of the main body 100. Also, a sealing ring 304 for preventing a storage space 201 from communicating with the outside through a space between the insides of the support part 102 is inserted. The operated part 300 is assembled vertically movable by a guide 104.

Also, the operated part 300 has a first discharge hole H1 and a second discharge hole H2 so that mixed contents within a container 700 ascends when the operated part 300 is mounted on upper and lower portions of a sealing ring 304.

Also, an ascending/descending operation part E1 is disposed to correspond to an ascending/descending operation groove E disposed in a center of the operated part 300. A discharge hole EH having a long groove shape is defined in a side of the ascending/descending operation part E1. The operation part 400 is coupled the ascending/descending operation part E1 through to a main body spout 101.

As necessary, a discharge device having various shapes may be disposed above the operation part 400 having the above-described structure to discharge the mixed contents within the container 700 without taking the bottle cap 1 off. Also, as shown in FIG. 16A, a discharge member 500 may be disposed above the operation part 400.

Figure 16:
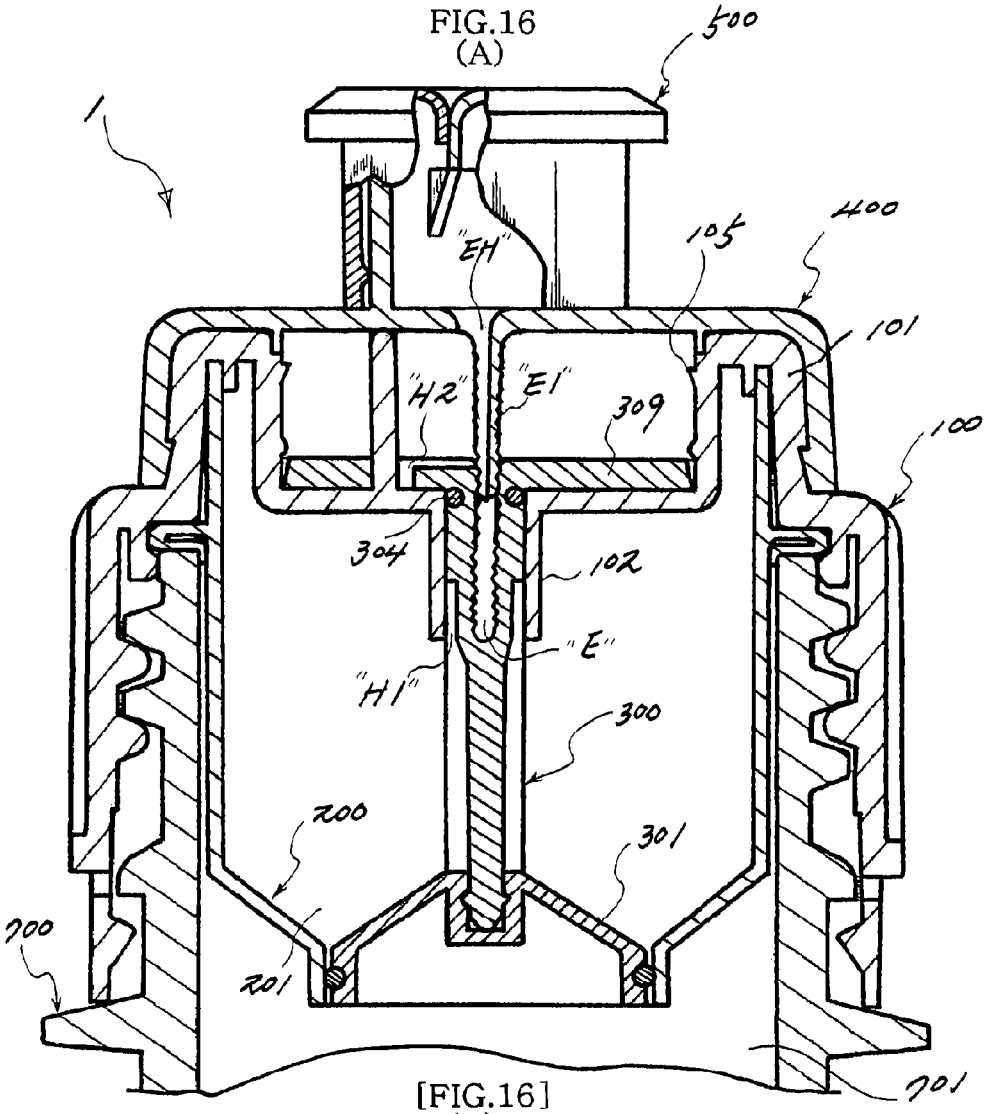
Figure 16:
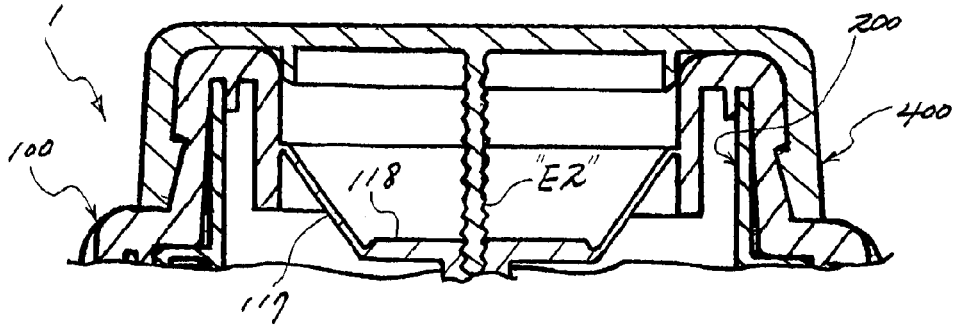

In the bottle cap 1 of the present invention, when the operation part 400 is operated in the state of FIG. 16A, the operated part 300 ascends by the ascending/descending operation part E1. In this process, when an opening part 301 ascends, an opening hole is opened. Here, a content within the storage space 201 is dropped and mixed into an inner space 701.

In this state, when the operation part 400 is continuously rotated, an outer circumference part of an operation plate 309 is hooked on a stopper 105. Thus, the operation part 400 is not rotated ever. In this state, when the discharge member 500 is lifted to press the container 700, the mixed contents are discharged through the discharge member 500 disposed above the discharge hole EH via the first discharge hole H1 and the second discharge hole H2.

According to further another embodiment (see FIG. 16B), in a bottle cap 1 of the present invention, when an operation part 400 assembled with a main body 100 of the bottle cap 1 is rotated, a foldable part 117 is folded downward. Also, an ascending/descending operation part E2 is disposed on an operation plate 118 disposed adjacent to the foldable part 117.

Here, when the operation part 400 is rotated, the ascending/descending operation part E2 lifts the operation plate 118. Also, the foldable part 117 turns inside out to allow the operation plate 118 to ascend. Also, when the operation plate 309 ascends, an operation part disposed on an end of a connection part extending downward opens an opening hole to drop and mix a content within a storage space into an inner space.

According to further another embodiment (see FIG. 17), in a bottle cap 1 containing heterogeneous materials, a main body 100 is assembled with a neck of a container 700, and a containing part 200 having a storage space 201 is coupled inside the main body. A lower opening hole 211 is closed by an opening part 301. The opening part 301 is connected to a connection member 121 of a button part 119 disposed on an upper portion of the main body 100.

Here, a content is put into the storage space 201 through the opening hole 211, and then the opening hole 211 is sealed by the opening part 301. In this process, the opening part 301 is fitted into the connection member 121. Also, the button part 119 is connected to a foldable part 120, and an upper side of the button part 119 may be covered by a protection plate or a strong protection cover to improve barrierability and safety.

Also, when the protection plate is removed and the button part 119 is pushed, the opening part 301 descends to a content within the storage space 201 is dropped and mixed into an inner space 701 through the opening hole 211. In this process, the foldable part 120 turns inside out as shown as a dot line in FIG. 17 to allow the button part 119 to descend.

Figure 17:
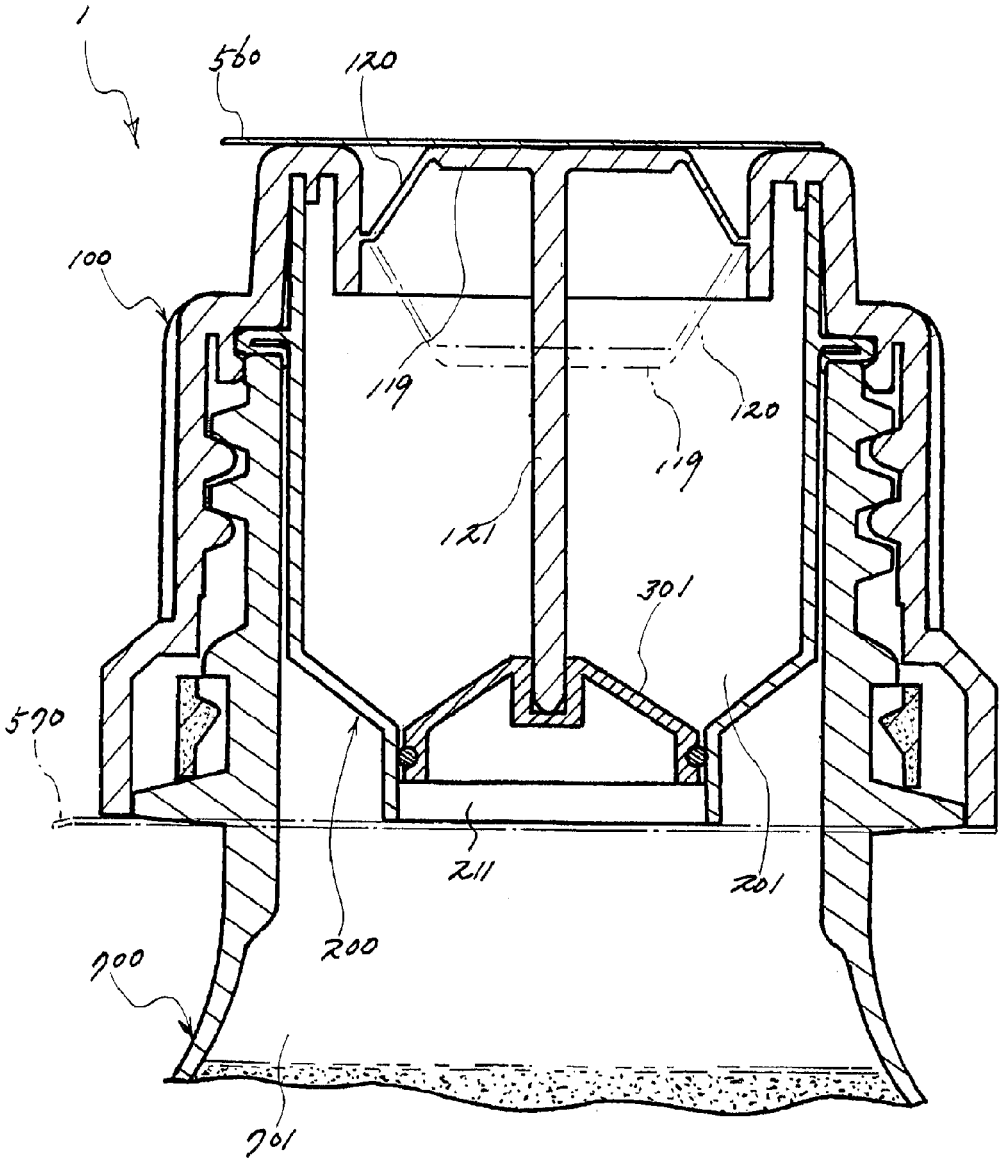
FIG. 17 is a cross-sectional view illustrating a structure in which a button part pushed to open a storage space is integrated with a main body by a foldable part.

Also, the main body 100 may be modified into various shapes. As shown in FIG. 17, a protection plate may be disposed on a lower end of the main body 100 to improve air-tightness. In this case, the bottle cap 1 may be separately distributed. A consumer may purchases the bottle cap 1 to remove a cap of a stored bottle purchased separately and replace with the bottle cap 1 of the present invention.

According to further another embodiment (see FIG. 18), in a bottle cap 1 containing heterogeneous materials, a main body 100 is coupled to a neck of a container 700. Also, a containing part 200 having a storage space 201 is assembled inside the main body 100.

A button part 119 including a foldable part 120 is disposed at an upper portion of the main body 100. A vertical discharge hole 122 having a lengthily extending tube shape is defined in a lower portion of the button part 119, i.e., a lower side of the button part 119.

Also, an opening part 301 for sealing an opening hole 211 is connected to a lower end of a connection part 123 having a tube shape and having the vertical discharge hole 122 therein.

In the bottle cap 1, a pump dispenser 580 is disposed above the button part 119. As necessary, a protection cover may cover the outside of the pump dispenser 580.

When the bottle cap 1 is not assembled with the neck of the containing 700, but is separately distributed, a discharge tube 332 may be separated, and a lower end of the main body 100 may be sealed by the protection plate 570.

In a method for putting the heterogeneous materials into the bottle cap 1, a content is put into the storage space 201 through the opening hole 211, and then the opening hole 211 is closed by the opening part 301. Here, the storage space 201 may communicate with the vertical discharge hole 122 within the connection part 123 through the discharge tube 332.

Here, when the button part 119 or the pump dispenser 580 is pushed, the foldable part 120 is folded, and the opening part 302 descends. In this process, the content within the storage space 201 is dropped and mixed into the inner space 701 through the opening hole 211.

Also, after the content within the storage space 201 is dropped and mixed, when the button 581 of the pump dispenser 580 is pushed, the mixed contents within the container 700 are discharged through a nozzle 582 via the discharge tube 332 and the vertical discharge hole 122.

According to further another embodiment (see FIG. 19), a containing part 200 having a storage space 201 is disposed within a main body 100 constituting a bottle cap 1. An opening hole 211 defined in a lower side of the storage space 201 is closed by an opening part 301. For this, the opening part 301 is assembled with an end of a connection part 125 lengthily extending from a button part 119 disposed at a lower portion of the main body 100.

A main body spout 126 is disposed above the button part 119. Also, a discharge member 590 that is an openable cover is coupled to the main body spout 126. A discharge hole sealing part 127 is disposed to open or close the discharge hole when the discharge member 590 is vertically moved.

Also, a first discharge hole 128 is defined in a connection part 125 so that mixed contents within a container 700 are discharged through the discharge member 590. A second discharge hole 129 communicating with the first discharge hole 128 is defined above the first discharge hole 128.

Here, when a safety protection cover 600 applied as necessary is removed and the discharge member 590 is pushed, a foldable part 120 is folded, and simultaneously, an opening part 301 is opened. Thus, a content within the storage space 201 is dropped and mixed into an inner space 701 of a container through the opening hole 211.

When the mixed contents are discharged as described above, the container 700 is laterally tilted, and the discharge member 590 is lifted to compress the container 700. Thus, the mixed contents within the container 700 are discharged through the first discharge hole 128 and the second discharge hole 129.

Figure 19:
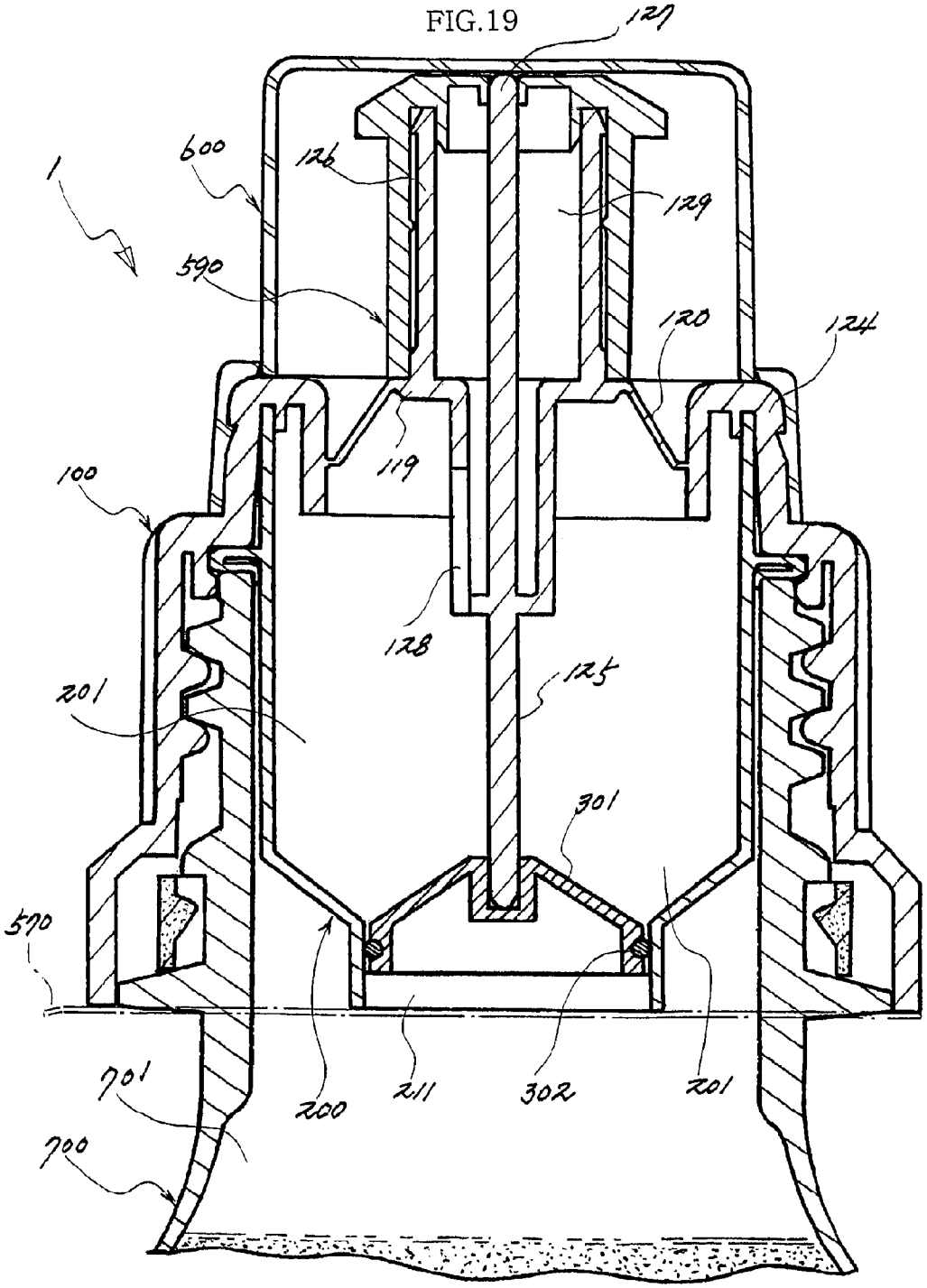

Also, although the discharge member 590 has one shape in FIG. 19, as necessary, the discharge member 590 may ascend or descend as shown in FIG. 19 or be rotated or vertically opened. That is, the discharge member 590 may be variously modified in structure to embody the idea of the prevent invention.

Figure 18:
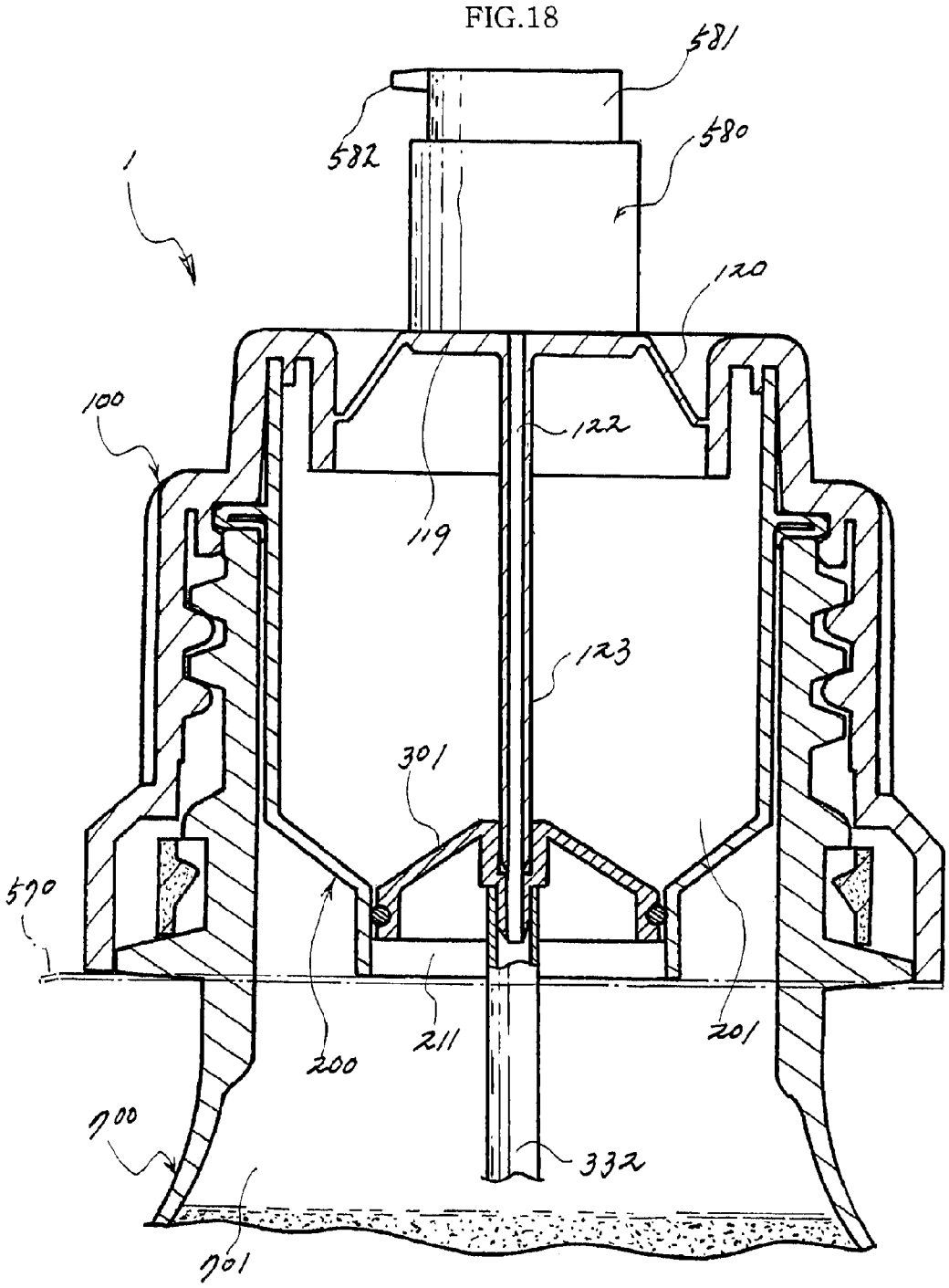

In further another embodiment (see FIG. 20), this embodiment is a modified example of FIG. 18. A material box 130 having a metering space 131 is disposed above a button part 119.

A lengthily extending vertical discharge hole 132 is defined above a vertical discharge hole 122 defined under the button part 119. A discharge hole 133 in which holes are laterally defined is defined in an end of the vertical discharge hole 132 to prevent a content from flowing upward.

The metering box 130 may be separately manufactured and then coupled or attached to the button part 119. Also, a cover 610 may be disposed on the metering box 130 to protect the metering box 130. The cover 610 may be provided as various types such as one touch type and screw type.

Furthermore, the bottle cap 1 of the present invention may is covered by a sealing plug 134 having a discharge hole opening hole 135 which is rotatably opened or closed so that a bottle is sealed before the discharge hole is used.

Here, when the protection cover 620, if existing, is moved and the metering box 130 is pushed, a foldable part 120 is folded to allow an opening part 301 to open an opening hole 211. In this process, a content within a storage space 201 is dropped and mixed into an inner space 701 of a container 700.

To discharge the mixed contents, when the container 700 is compressed, the mixed contents are moved into a vertical discharge hole 122 through a discharge tube 332. Then, the mixed contents are moved into the meter space 131 through the discharge hole 133 by an amount corresponding to the compressed pressure.

Also, a metering gradation is displayed on the metering box 130. When the contents are discharged, the cover 610 is removed. Also, in a case where a sealing plug 134 exists, the sealing plug 134 may be rotated and then set to match the discharge hole 133, thereby compressing the container 700.

Furthermore, a sealing part is disposed on a lower portion of a top surface of the cover 610 to seal the discharge hole 133.

According to further another embodiment (see FIG. 21), in a bottle cap 1 of the present invention, mixed contents within a container 700 may be extracted using a separate syringe.

Figure 21:
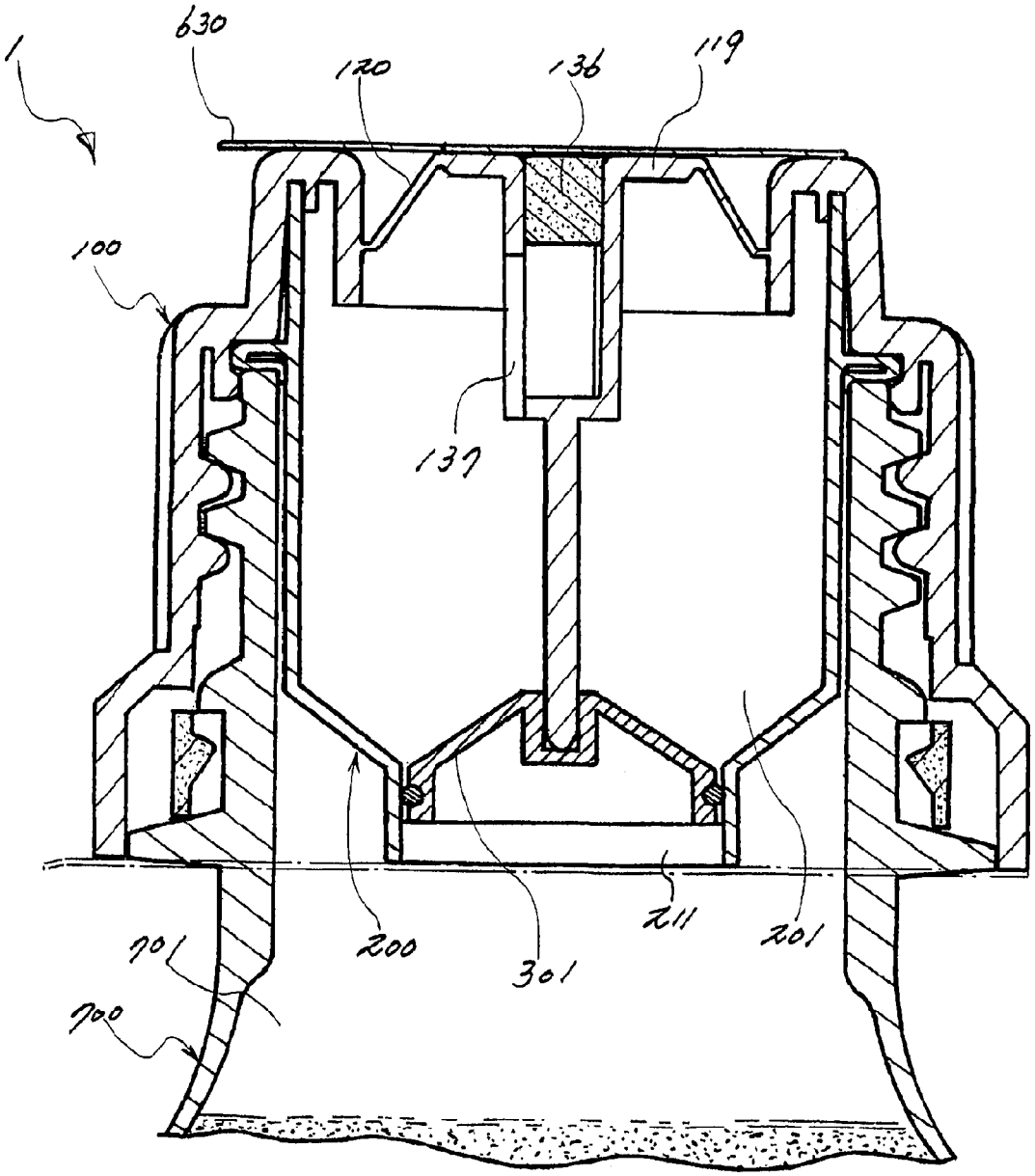

As shown in FIG. 21, a rubber plug 136 is coupled inside a button part 119, and a discharge hole 137 for suctioning the mixed contents using the syringe is defined in a lower portion of the rubber plug 136.

Here, when a protection cover or a protection plate 630, if existing, is removed and button part 119 is pushed, a foldable part 120 is folded downward, and simultaneously, an opening part 301 connected to a connection part 138 is opened to drop and mix a content within a storage space 201 into a container 700.

Also, when the mixed contents are discharged, a syringe is inserted into a rubber plug 136 to extract the mixed contents, thereby discharge the mixed contents through a discharge hole 137.

Referring to FIGS. 17 to 21, the main body 100 of the bottle cap 1 may be variously changed in design so that the main body 100 is coupled to the container 700 through various methods such as one touch method or screw method.

According to further another embodiment (see FIG. 22), at least two spaces in which heterogeneous materials are contained are defined inside a bottle cap 1. A containing part 200 having a storage space 201 is coupled to inside a main body 100. Also, a button part 119 connected to a foldable part 120 foldable downward is disposed above the storage space 201.

Also, an auxiliary space 139 is defined under the button part 119. A lower side of the auxiliary space 139 is sealed by a sealing part 140 having a sealing property. Also, a punching pin 141 which can break the sealing part 140 is disposed on the bottom of an upper portion of the button part 119.

Also, a lengthily extending connection part 142 is disposed on the button part 119, and an opening part 301 is disposed on a lower end of the connection part 142. A lower storage space 143 that is the other space is defined under the opening part 301. A lower side of the lower storage space 143 is sealed by a sealing part 144.

Here, when a protection plate, if existing, is moved and the button part 119 is pushed, the punching pin 141 breaks the sealing part 140 to drop a content within the auxiliary space 139 into the storage space 201, and simultaneously, the opening part 310 descends to drop and mix the content within the storage space 201 into a space 701 within the container 700.

In this process, the sealing part 144 disposed under the opening part 301 is broken by the punching pin 145, and simultaneously, the content within the lower storage space 143 is dropped and mixed into the inner space 701 of the container 700.

Also, a portion of the punching pin 145 may have a flat shape to prevent the broken sealing part 144 from being dropped into the container 700 so that the portion of the sealing part 144 is attached to a lower end of a containing part 200.

Figure 20:
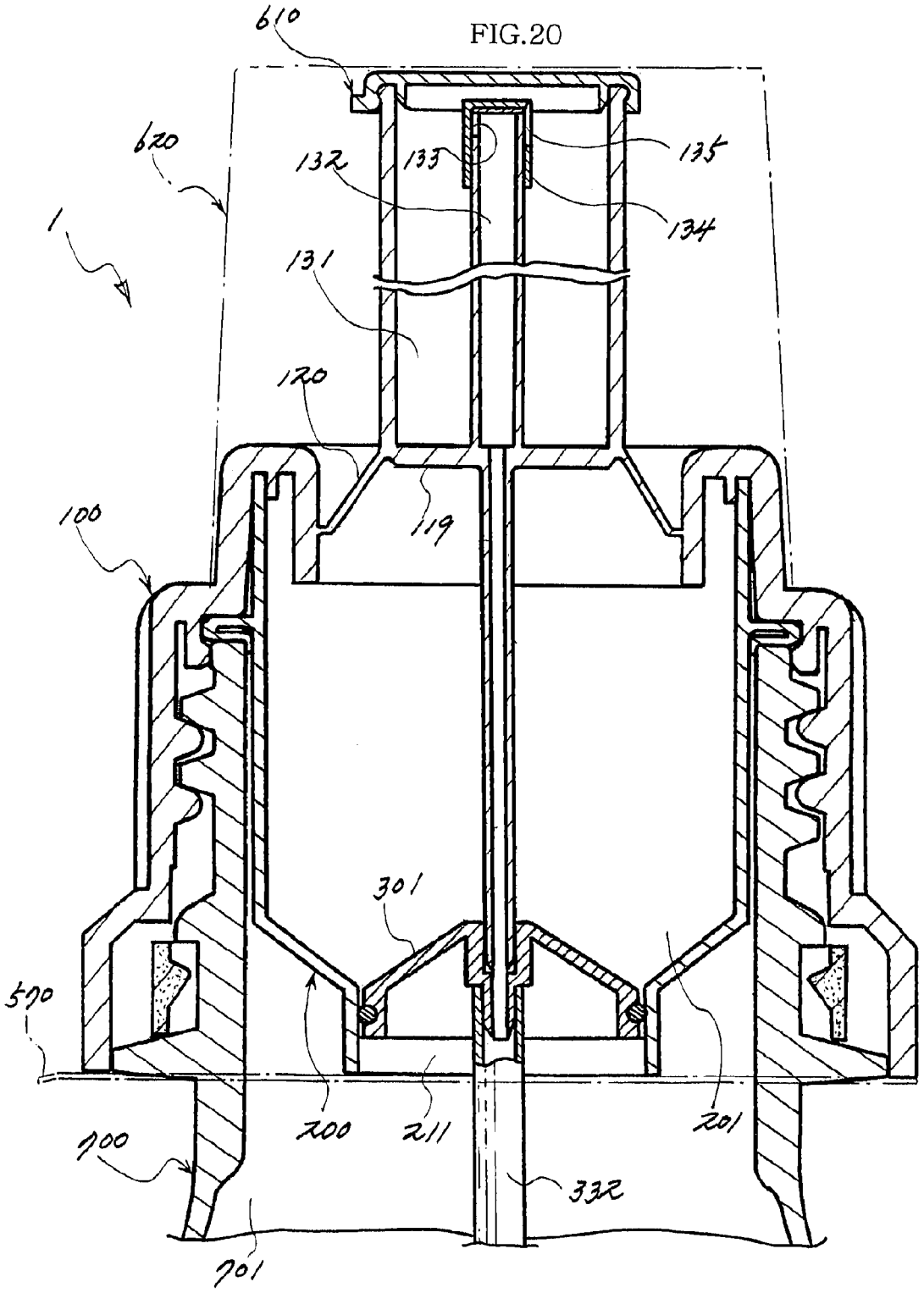

When the mixed contents are discharged, the bottle cap 1 may be taken off from a neck of the container 700. However, as necessary, as shown in FIGS. 18, 19, and 20, a pump dispenser 580, a discharge member 590, or a metering box 130 may be added to the button part 119.

Figure 22:
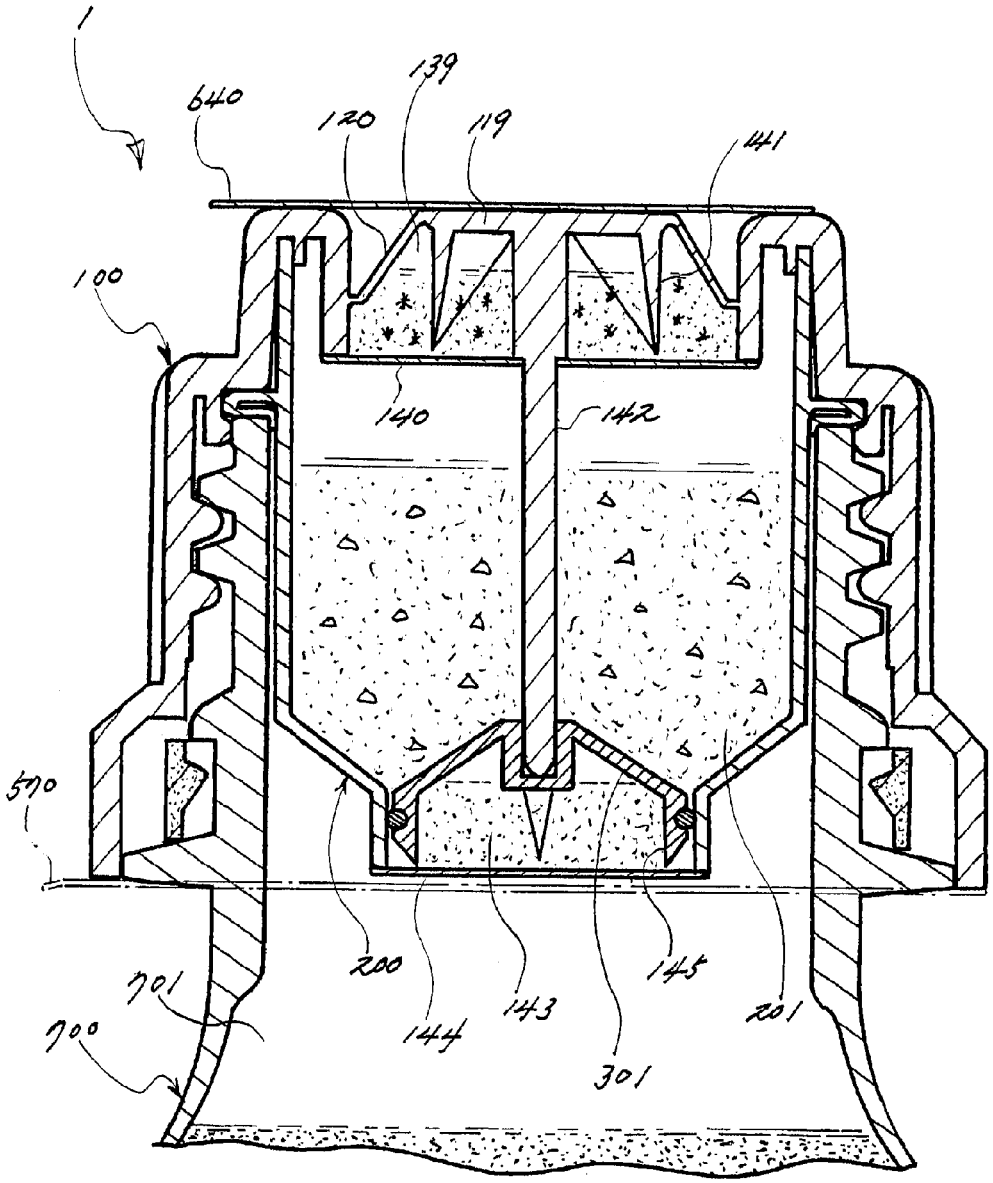
Figure 23:
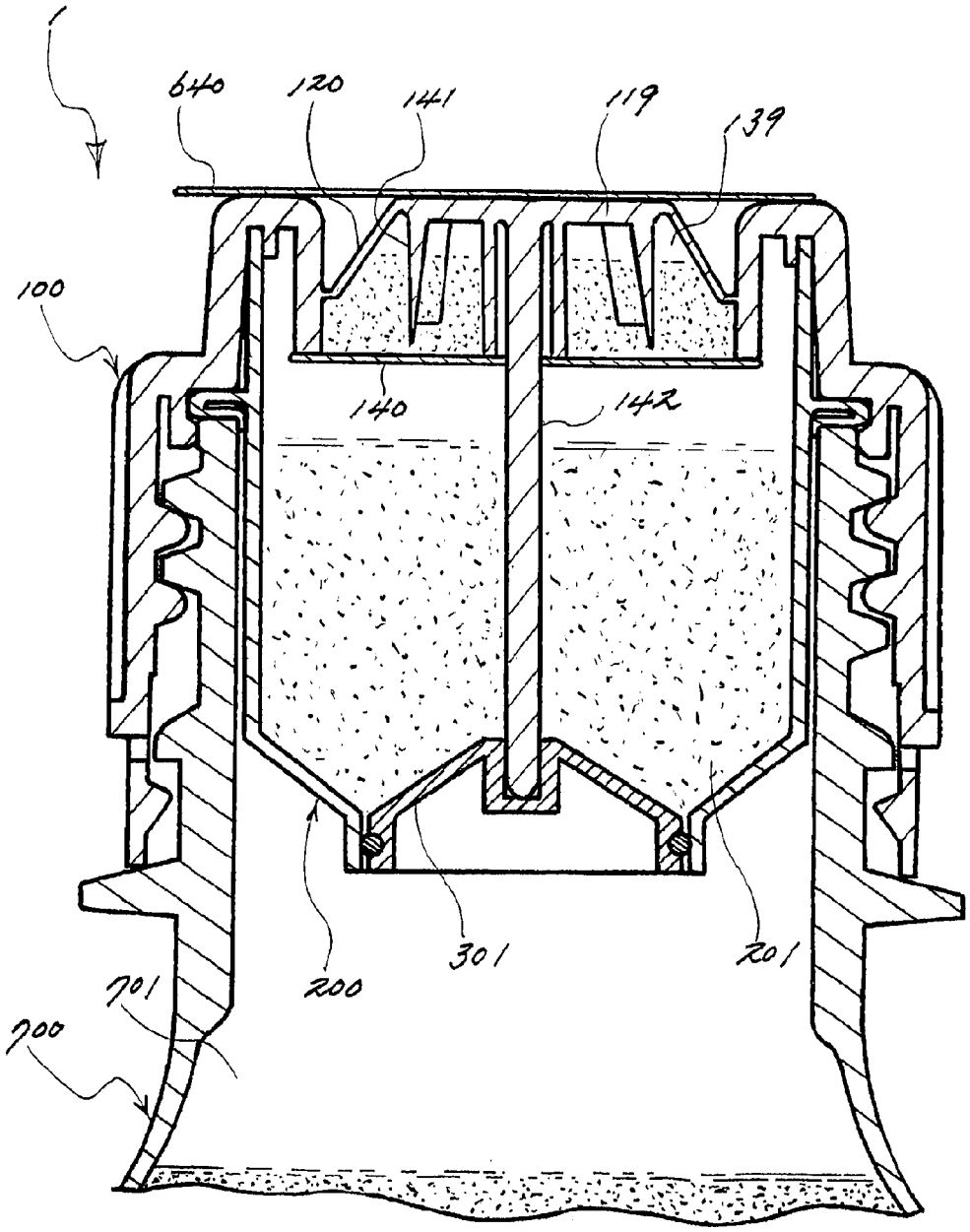

According to further another embodiment (see FIG. 23), this embodiment is a modified example of FIG. 22. That is, two storage spaces for containing heterogeneous materials are defined. As shown in drawings, a lower storage space 143 defined under the opening part 301 is omitted.

Here, when a protection plate 640, if existing, is moved and a button part 119 is pushed, a sealing part 140 is broken by a punching pin 141 to drop a content within an auxiliary space 139 into a storage space 201, and simultaneously, a content within the storage space 201 is dropped and mixed into a container 700 through an opening hole while an opening part 301 is opened.

Figure 24:
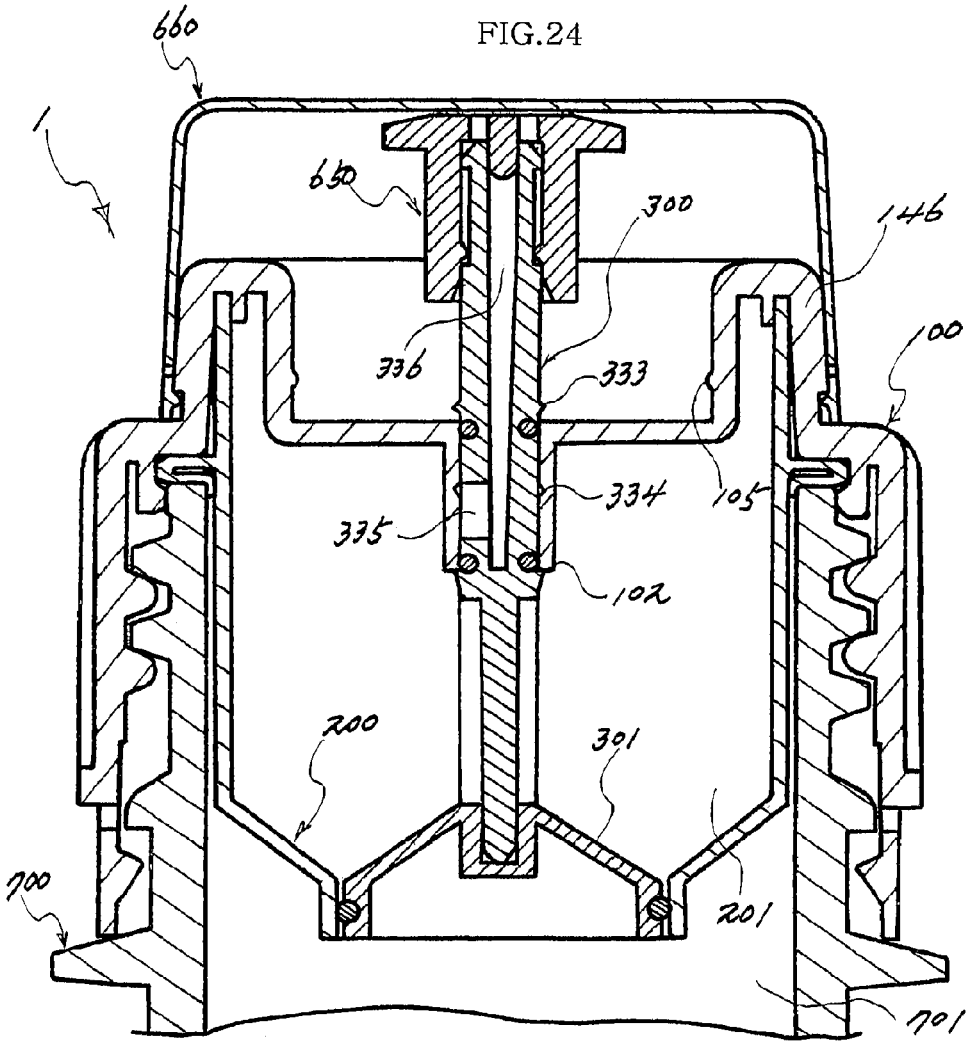

According to further another embodiment (see FIG. 24), in a bottle cap 1 containing heterogeneous materials, a main body 100 is coupled to a neck of a container 700. Also, a containing part 200 having a storage space 201 is assembled inside the main body 100. Also, an opening hole 301 of the storage space 201 is sealed by an opening part 301.

An operated part 300 is coupled in the center of a support part 102 within the main body 100, and a lower end of the operated part 300 is connected to an opening part 301. Also, a discharge member 650 that is a unit for discharging mixed contents is disposed above the operated part 300.

Here, when a protection cover 650, if existing, is removed and a discharge member 650 is pushed, the opening part 301 connected to the discharge member 650 is opened to drop and mix a content within the storage space 201 into a space 701 within a container 700 through an opening hole.

Also, when the operated part 300 descends with respect to a support part 102, a stopper 333 is hooked on a stopper groove 334 and a first discharge hole 335 is opened.

Also, in this state, when the mixed contents within the container 700 are discharged, the discharge member 650 is lifted to open a vertical discharge hole 336. Then, the container 700 is tilted and compressed to discharge the mixed contents through the first discharge hole 335 and the vertical discharge hole 336.

Figure 25:
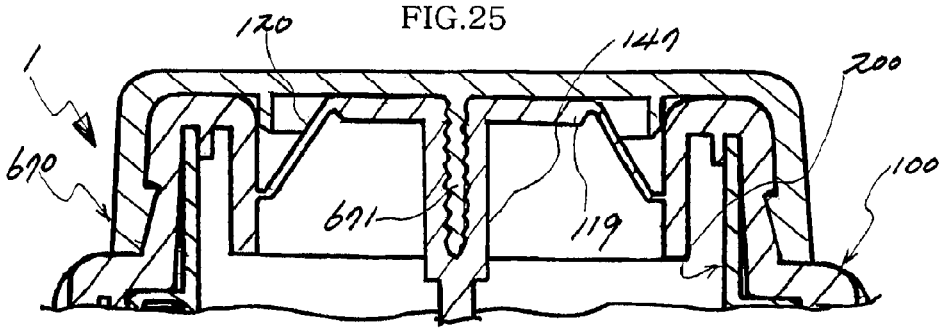

According to further another embodiment (see FIG. 25), a bottle cap 1 of the present invention may be changed in structure so that the button part 119 of the bottle cap 1 of FIG. 17 descends by a separate auxiliary unit without pushing the button part 119.

Preferably, a separate operation part 670 for moving the button part 119 downward may be provided. Here, a descending operation part 671 of the operation part 670 may be assembled with a groove defined in a center of a connection member 147 corresponding thereto so that the button part 119 descends when the operation part 670 is rotated.

Here, when the operation part 670 of the bottle cap 1 is rotted, the descending operation part 671 pushes the button part 119 downward, and simultaneously, an opening part disposed on a lower portion of the connection member 147 is opened to drop and mix a content within the storage space into a space within a container.

For reference, as described above, specifically in FIGS. 18 to 21, when the pump dispenser 580, the discharge member 590, or the metering box 130 which is disposed above the button part 119 is pulled in a state where the foldable part 120 descends, the opening part 301 sealing the lower side of the storage space 201 is opened to drop and mix the content into the container 700 through the opening hole.

INDUSTRIAL APPLICABILITY

The present invention relates to a structure of a containing device which can efficiently mix concentrate with water, concentrate with general beverages, pulp with water, or powder with water, and so on. General beverages for improving mixing properties of heterogeneous materials may be applied to alcoholic beverages, chemicals, or the like.

The invention claimed is:

1. A bottle cap disposed in a content discharge direction of a container to contain heterogeneous materials, the bottle cap comprising:

a main body coupled to a neck of the container; and a containing part having a storage space, the containing part being assembled inside the main body, wherein an operated part assembled in a direction of a receiving part from an upper portion of the main body comprises an opening part on a lower end thereof to seal an opening hole of the storage space, an upper auxiliary space defined by coupling the operated part to the main body is sealed from the storage space defined thereunder, and when the operated part is pushed, a content within the auxiliary space is dropped into the lower storage space, and simultaneously, a content within the storage is dropped and mixed into the container through the opening hole defined by opening the opening part while the operated part descends.

2. The bottle cap of claim 1, wherein the content within the storage space of the containing part and the content within the auxiliary space defined above the storage space are separated from each other because the operated part coupled in a center of a support part of the main body is closely assembled, and when an operation plate disposed above the operated part is pushed, the operated part descends to expose a first discharge hole defined inside the support part, and simultaneously, the content within the auxiliary space is dropped into the storage space through the first discharge hole.

3. The bottle cap of claim 1, wherein a first discharge hole and the auxiliary space communicate with each other.

4. The bottle cap of claim 1, wherein a content is put into the auxiliary space through a vertical hole of the operated part, and the vertical hole is sealed as a separate space sealing part.

5. The bottle cap of claim 1, wherein an elastic stopper corresponding part for maintaining sealing to an outer circumference of an operation plate is disposed to provide air-tightness between the operated part and the main body.

6. The bottle cap of claim 5, wherein, when the stopper corresponding part is hooked on a stopper of the main body, the stopper corresponding part does not return to prevent the bottle cap from being reused.

7. The bottle cap of claim 1, wherein a protection cover or a protection plate is disposed to protect the operated part.

8. A bottle cap disposed in a content discharge direction of a container to contain heterogeneous materials, the bottle cap comprising:

a main body coupled to a neck of the container; and a containing part having a storage space inside the main body, wherein an operated part assembled in a direction of a receiving part from an upper portion of the main body comprises an opening part on a lower end thereof to seal an opening hole of the storage space, an upper auxiliary space defined by coupling the operated part to the main body is sealed from the storage space defined thereunder, and when the operated part is pushed, a content within the auxiliary space is dropped into the lower storage space, and simultaneously, a content within the storage space is dropped and mixed into the container through the opening hole defined by opening the opening part while the operated part descends.

9. The bottle cap of claim 1, wherein a cut-out surface having a cutting line is disposed on the bottom of the auxiliary space so that the content within the auxiliary space is dropped into the storage space defined thereunder when the operated part is pushed, and a long protrusion having a predetermined length is disposed above the cut-out surface so that the cut-out surface is broken when the operated part is pushed.

10. The bottle cap of claim 9, wherein, when the content is put into the auxiliary space, a portion of the auxiliary space is punched to put the content through the punched corresponding portion, and then the punched corresponding portion is sealed.

11. A bottle cap disposed in a content discharge direction of a container to contain heterogeneous materials, the bottle cap comprising:

a main body coupled to a neck of the container; and a containing part having a storage space inside the main body, wherein the storage space of the containing part has an opening hole sealed by an end of an operated part coupled to an upper portion of the main body to extend, an auxiliary space in which an other content is put is defined under the opening part and an end sealed by a protection plate, and when the operated part is pushed, an opening part connected to the end of the operated part descends to open an opening hole, and simultaneously, the protection is opened by the end of the opening part to drop and mix a content within the storage space and the content within the auxiliary space into a space within the container.

12. The bottle cap of claim 11, wherein an operation part stopper is disposed between an upper operation plate of the operated part and the main body to prevent the operation plate from being pushed randomly.

13. The bottle cap of claim 11, wherein a stopper is disposed on the main body corresponding to the operated part to prevent the operated part from returning after the operated part descends.

14. The bottle cap of claim 11, wherein the operated part is coupled in a center of a support part, and a sealing ring is disposed between the support part and the operated part to maintain sealing between the main body and the operated part.

15. The bottle cap of claim 11, wherein a punching pin is disposed on a lower end of the opening part closing the opening hole of the storage space to easily break a protection plate of the auxiliary space.

16. The bottle cap of claim 11, wherein the containing part having the storage space is assembled with the main body of the container.

17. A bottle cap disposed in a content discharge direction of a container to contain heterogeneous materials, the bottle cap comprising:

a main body coupled to a neck of the container; and a containing part having a storage space inside the main body, wherein the storage space of the containing part is sealed by an opening part connected to an end of an operated part lengthily extending from an upper portion of the main body to the storage space, a separate auxiliary space separated from the storage space defined thereunder is defined above a top surface of the operated part extending from an upper portion of the main body to a side of the storage space, and when the operated part is pushed, a content within the auxiliary space is dropped into the lower storage space, and simultaneously, a content within the storage space is dropped and mixed into the container through an opening hole defined by opening the opening part.

18. The bottle cap of claim 17, wherein the operated part is closely attached to an inner wall of the support part of the main body to maintain air-tightness between the auxiliary space and the storage space.

19. The bottle cap of claim 17, wherein a discharge hole is defined in a lower lateral side of the auxiliary space, and a sealing ring is disposed on an outer circumference of an lower end of the discharge hole to maintain air-tightness between the storage space and the auxiliary space before the operated part gets out of the support part of the main body.

20. The bottle cap of claim 17, wherein an auxiliary space sealing plug is disposed on an upper side of the auxiliary space.

21. The bottle cap of claim 20, wherein a protection plate is disposed above the operated part comprising the auxiliary space sealing plug.

22. The bottle cap of claim 17, wherein an operation part stopper is disposed between the operation plate of the operated part and the main body to prevent the operated part from descending randomly.

23. A bottle cap disposed in a content discharge direction of a container to contain heterogeneous materials, the bottle cap comprising:

a main body coupled to a neck of the container; and an auxiliary space defined under a top surface of the main body, a containing part having a storage space separated from the auxiliary space is assembled inside the main body having the auxiliary space, an operated part extending lengthily is disposed in a central axis direction of the auxiliary space and the storage space, after a content is put into the auxiliary space, a sealing opening part is assembled in the center of the central axis of the operated part, after a content is put into the storage space, an opening part is assembled with an end of the central axis of the operated part to seal an opening hole of the storage space, an upper side of the operated part is sealed by a support part of the main body to separate the content within the storage space from the content within the auxiliary space, and since the operated part comprises an operation plate, when the operation plate is pushed, the content within the auxiliary space and the content within the storage space are dropped and mixed into a space within the container.

24. The bottle cap of claim 23, wherein an operation part stopper is disposed between the operation plate of the operated part and the main body to prevent the operated part from being pushed randomly.

* * * * *